US009000405B2

(12) United States Patent
Fleurov et al.

(10) Patent No.: US 9,000,405 B2
(45) Date of Patent: Apr. 7, 2015

(54) BEAM POSITION CONTROL FOR AN EXTREME ULTRAVIOLET LIGHT SOURCE

(71) Applicant: ASML Netherlands B.V., Veldhoven (NL)

(72) Inventors: Vladimir B. Fleurov, Escondido, CA (US); Igor V. Fomenkov, San Diego, CA (US)

(73) Assignee: ASML Netherlands B.V. (NL)

( * ) Notice: Subject to any disclaimer, the term of this patent is extended or adjusted under 35 U.S.C. 154(b) by 0 days.

(21) Appl. No.: 14/184,777

(22) Filed: Feb. 20, 2014

(65) Prior Publication Data

US 2014/0264091 A1 Sep. 18, 2014

Related U.S. Application Data

(60) Provisional application No. 61/787,228, filed on Mar. 15, 2013.

(51) Int. Cl.
*H05G 2/00* (2006.01)
*G21K 5/00* (2006.01)
*G21K 5/10* (2006.01)

(52) U.S. Cl.
CPC ..... *H05G 2/008* (2013.01); *G21K 5/00* (2013.01); *G21K 5/10* (2013.01)

(58) Field of Classification Search
CPC ..... G21K 5/00; G21K 5/10; H05G 2/008
USPC ..... 250/504 R
See application file for complete search history.

(56) References Cited

U.S. PATENT DOCUMENTS 7,164,144 B2 1/2007 Partlo et al.
7,388,200 B2 6/2008 Stewart et al.

(Continued)

FOREIGN PATENT DOCUMENTS

WO WO2012046133 4/2012

OTHER PUBLICATIONS

U.S. Appl. No. 14/035,847, titled System and Method for Laser Beam Focus Control for Extreme Ultraviolet Laser Produced Plasma Source, filed Sep. 24, 2013, 25 pages.

(Continued)

*Primary Examiner* — Nicole Ippolito
*Assistant Examiner* — Wyatt Stoffa
(74) *Attorney, Agent, or Firm* — DiBerardino McGovern IP Group LLC

(57) ABSTRACT

A system for an extreme ultraviolet light source includes one or more optical elements positioned to receive a reflected amplified light beam and to direct the reflected amplified light beam into first, second, and third channels, the reflected amplified light beam including a reflection of at least a portion of an irradiating amplified light beam that interacts with a target material; a first sensor that senses light from the first channel; a second sensor that senses light from the second channel and the third channel, the second sensor having a lower acquisition rate than the first sensor; and an electronic processor coupled to a computer-readable storage medium, the medium storing instructions that, when executed, cause the processor to: receive data from the first sensor and the second sensor, and determine, based on the received data, a location of the irradiating amplified light beam relative to the target material in more than one dimension.

15 Claims, 19 Drawing Sheets

(56) References Cited

U.S. PATENT DOCUMENTS

| | | | | |
|---|---|---|---|---|
| 7,411,203 | B2 | 8/2008 | Fomenkov et al. | |
| 7,449,704 | B2 * | 11/2008 | Fomenkov et al. | 250/504 R |
| 7,482,609 | B2 | 1/2009 | Ershov et al. | |
| 8,000,212 | B2 * | 8/2011 | Senekerimyan et al. | 369/121 |
| 8,242,472 | B2 | 8/2012 | Moriya et al. | |
| 8,395,133 | B2 | 3/2013 | Moriya et al. | |
| 8,399,870 | B2 | 3/2013 | Moriya et al. | |
| 8,698,114 | B2 | 4/2014 | Moriya et al. | |
| 8,866,110 | B2 * | 10/2014 | Tao et al. | 250/504 R |
| 2005/0205810 | A1 * | 9/2005 | Akins et al. | 250/504 R |
| 2010/0078577 | A1 * | 4/2010 | Moriya et al. | 250/504 R |
| 2011/0141865 | A1 * | 6/2011 | Senekerimyan et al. | 369/47.15 |
| 2012/0019826 | A1 * | 1/2012 | Graham et al. | 356/400 |
| 2012/0319014 | A1 | 12/2012 | Moriya | |
| 2013/0020511 | A1 * | 1/2013 | Kameda et al. | 250/504 R |
| 2013/0208742 | A1 * | 8/2013 | Mizoguchi et al. | 372/27 |

OTHER PUBLICATIONS

International Search Report and Written Opinion of the International Searching Authority for International Application No. PCT/US2014/018419, mailed Jun. 6, 2014, 13 pages.

* cited by examiner

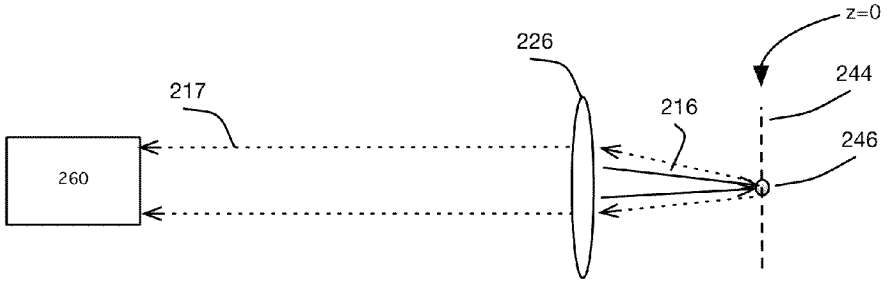
FIG. 13A
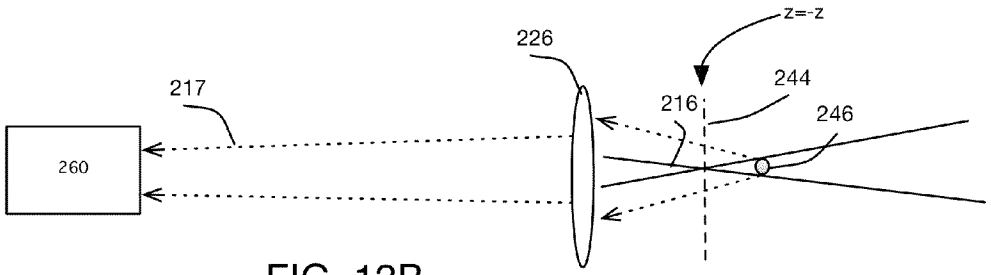
FIG. 13B
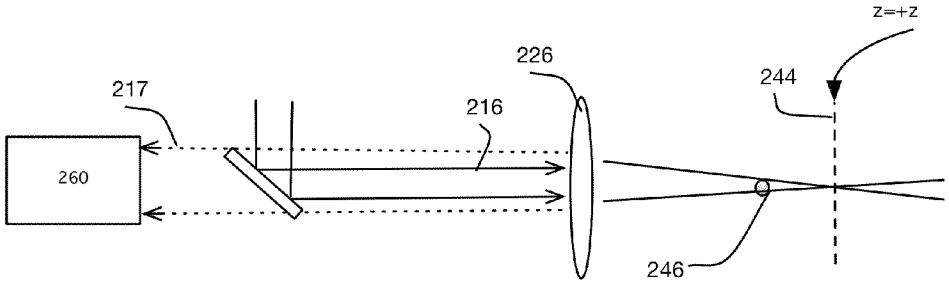
FIG. 13C
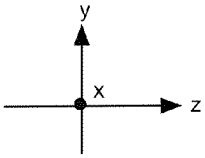

BEAM POSITION CONTROL FOR AN EXTREME ULTRAVIOLET LIGHT SOURCE

CROSS-REFERENCE TO RELATED APPLICATIONS

This application claims the benefit of U.S. Provisional Application No. 61/787,228, filed on Mar. 15, 2013 and titled BEAM POSITION CONTROL FOR AN EXTREME ULTRAVIOLET LIGHT SOURCE, which is incorporated herein by reference in its entirety.

TECHNICAL FIELD

The disclosed subject matter relates to beam position control for an extreme ultraviolet (EUV) light source.

BACKGROUND

Extreme ultraviolet (EUV) light, for example, electromagnetic radiation having wavelengths of around 50 nm or less (also sometimes referred to as soft x-rays), and including light at a wavelength of about 13 nm, can be used in photolithography processes to produce extremely small features in substrates, for example, silicon wafers.

Methods to produce EUV light include, but are not necessarily limited to, converting a material that has an element, for example, xenon, lithium, or tin, with an emission line in the EUV range into a plasma state. In one such method, often termed laser produced plasma (LPP), the plasma can be produced by irradiating a target material, for example, in the form of a droplet, stream, or cluster of material, with an amplified light beam that can be referred to as a drive laser. For this process, the plasma is typically produced in a sealed vessel, for example, a vacuum chamber, and monitored using various types of metrology equipment.

SUMMARY

In one general aspect, a system for an extreme ultraviolet light source includes one or more optical elements positioned to receive a reflected amplified light beam and to direct the reflected amplified light beam into first, second, and third channels, the reflected amplified light beam including a reflection of at least a portion of an irradiating amplified light beam that interacts with a target material; a first sensor that senses light from the first channel; a second sensor that senses light from the second channel and the third channel, the second sensor having a lower acquisition rate than the first sensor; and an electronic processor coupled to a computer-readable storage medium, the medium storing instructions that, when executed, cause the processor to: receive data from the first sensor and the second sensor, and determine, based on the received data, a location of the irradiating amplified light beam relative to the target material in more than one dimension.

Implementations can include one or more of the following features.

The medium can further store instructions that, when executed, cause the processor to determine an adjustment to the irradiating amplified light beam based on the determined location. The determined adjustment can include distances, in more than one dimension, to move the irradiating amplified light beam.

The instructions to cause the processor to determine a location of the irradiating amplified light beam can include instructions that, when executed cause the processor to determine a location of a focus position of the irradiating amplified light beam relative to the target material in a direction that is parallel to a direction of propagation of the irradiating amplified light beam, and determine a location of the focus position of the irradiating amplified light beam relative to the target material in a first transverse direction that is perpendicular to the direction of propagation of the irradiating amplified light beam. The instructions can further include instructions that, when executed, cause the processor to determine a location of the focus position of the irradiating amplified light beam in a second transverse direction that is perpendicular to the first transverse direction and perpendicular to the direction of propagation of the irradiating amplified light beam.

The system also can include an astigmatic optical element, positioned in the third channel, that modifies a wavefront of the reflected amplified light beam.

The system also can include multiple partially reflective non-astigmatic optical elements, each positioned at a different location in the third channel and each receiving at least part of the reflected amplified light beam, each of the multiple partially reflective optics forming a beam that follows a path of a different length between the target material and the second detector.

The first, second, and third channels can be three separate paths, each defined by one or more refractive or reflective optical elements that direct a portion of the reflected amplified light beam.

The reflected amplified light beam can include a reflection of a pre-pulse beam and a drive beam, the drive beam being an amplified light beam that converts the target material to plasma upon interaction, and the pre-pulse and drive beams can include different wavelengths, and the system can further include one or more spectral filters that are transparent to only one of the pre-pulse beam and the drive beam.

The first sensor can senses light pointing at a high acquisition rate from the first channel; the second sensor can include a two-dimensional imaging sensor that senses light and measures intensity distribution of the light from the second channel and the third channel; and the instructions that, when executed, cause the processor to determine, based on the received data, a location of the irradiating amplified light beam, can cause the processor to determine a focus position of the irradiating amplified light beam relative to the target material in more than one dimension.

In another general aspect, aligning an irradiating amplified light beam relative to a target material includes accessing first, second, and third measurements of a reflected amplified light beam, the first measurement obtained from a first sensor, the second and third measurements obtained from a second sensor having a lower acquisition rate than the first sensor, and the reflected amplified light beam being a reflection of the irradiating amplified light beam from a target material; determining, based on the first measurement, a first location of the amplified light beam relative to the target material in a direction that is perpendicular to the direction of propagation of the irradiating amplified light beam; determining, based on the second measurement, a second location of the amplified light beam relative to the target material in a direction that is perpendicular to the direction of propagation of the irradiating amplified light beam; determining, based on the third measurement, a location of a focus position of the amplified light beam relative to the target material in a direction that is parallel to the direction of propagation of the irradiating amplified light beam; and repositioning the irradiating amplified light beam to relative to the target material based on one or more of the first location, the second location, or the location of the focus position to align the irradiating amplified light beam relative to the target material.

Implementations can include one or more of the following features.

An adjustment to the location of the focus position of the amplified light beam can be determined based on the determined location of the focal position, and repositioning the irradiating amplified light beam can include moving the focus position of the irradiating amplified light beam based on the determined adjustment to the location of the focus position.

An adjustment to the amplified light beam can be determined based on one or more of the determined first location or the determined second location.

The amplified light beam can be a pulse of light, the determined first location can be a location of the amplified light beam focus relative to the target material in a direction parallel to a direction in which the target material travels, and the determined adjustment to the alignment to the amplified light beam can be a distance between the amplified light beam and the target material in the direction parallel to the direction in which the target material travels, and repositioning the irradiating amplified light beam pulse can include causing a delay in the amplified light beam that corresponds to the distance between the amplified light beam and the target material such that a subsequent pulse of light intersects a target material.

The determined second location can include a location of the amplified light beam in a direction that is perpendicular to the direction in which the target material travels and perpendicular to a direction of propagation of the amplified light beam, and the determined adjustment to the alignment of the amplified light beam can include a distance between the amplified light beam and the target material location, and repositioning the irradiating amplified light beam can include generating an output based on the determined adjustment, the output being sufficient to cause repositioning of an optical assembly that steers the amplified light beam; and providing the output to the optical assembly.

Repositioning the irradiating amplified light beam can include generating an output based on the determined adjustment to the location of the focus position, the output being sufficient to cause repositioning of an optical element that focuses the amplified light beam; and providing the output to an optical assembly that includes the optical element.

The third measurement can include an image of the reflected amplified light beam, and determining a location of the focus position of the amplified light beam can include analyzing the image to determine a shape of the reflected amplified light beam. Analyzing the image to determine a shape of the reflected amplified light beam can include determining an ellipticity of the reflected amplified light beam.

The third measurement can include images of the reflected amplified light beam sampled at multiple locations, and determining a location of the focus position of the amplified light beam can include comparing the widths of the reflected amplified light beam at two or more of the multiple locations.

In another general aspect, an extreme ultraviolet light system includes a source that produces an irradiating amplified light beam; a steering system that steers and focuses the irradiating amplified light beam toward a target material in a vacuum chamber; a beam positioning system that includes one or more optical elements positioned to receive a reflected amplified light beam that is reflected from the target material and to direct the reflected amplified light beam into first, second, and third channels; a first sensor that senses light from the first channel; a second sensor, which includes a two-dimensional imaging sensor, that senses light from the second channel and the third channel, the second sensor having a lower acquisition rate than the first sensor; and an electronic processor coupled to a computer-readable storage medium, the medium storing instructions that, when executed, cause the processor to receive data from the first sensor and the second sensor, and determine, based on the received data, a location of the irradiating amplified light beam relative to the target material in more than one dimension.

Implementations can include one or more of the following features. The medium can further store instructions that, when executed, cause the processor to determine an adjustment to the location of the irradiating amplified light beam based on the determined location. The determined adjustment can include an adjustment in more than one dimension.

The instructions to cause the processor to determine a location of the irradiating amplified light beam relative to the target material can include instructions that, when executed cause the processor to determine a location of a focus of the irradiating amplified light beam relative to the target material in a direction that is parallel to a direction of propagation of the irradiating amplified light beam, and determine a location of the irradiating amplified light beam focus position relative to the target material in first and second transverse directions, each of which are perpendicular to the direction of propagation of the irradiating amplified light beam.

The instructions can further include instructions that, when executed, cause the processor to determine an adjustment to the amplified light beam based on the determined location of the amplified light beam, and provide the generated output to the steering system.

Implementations of any of the techniques described above may include a method, a process, an assembly, a device, a kit or pre-assembled system for retrofitting an existing EUV light source, executable instructions stored on a computer-readable medium, or an apparatus. The details of one or more implementations are set forth in the accompanying drawings and the description below. Other features will be apparent from the description and drawings, and from the claims.

DRAWING DESCRIPTION

FIGS. 13A-13C show side views of an irradiating amplified light beam relative to a target material.

DESCRIPTION

Figure 1A:
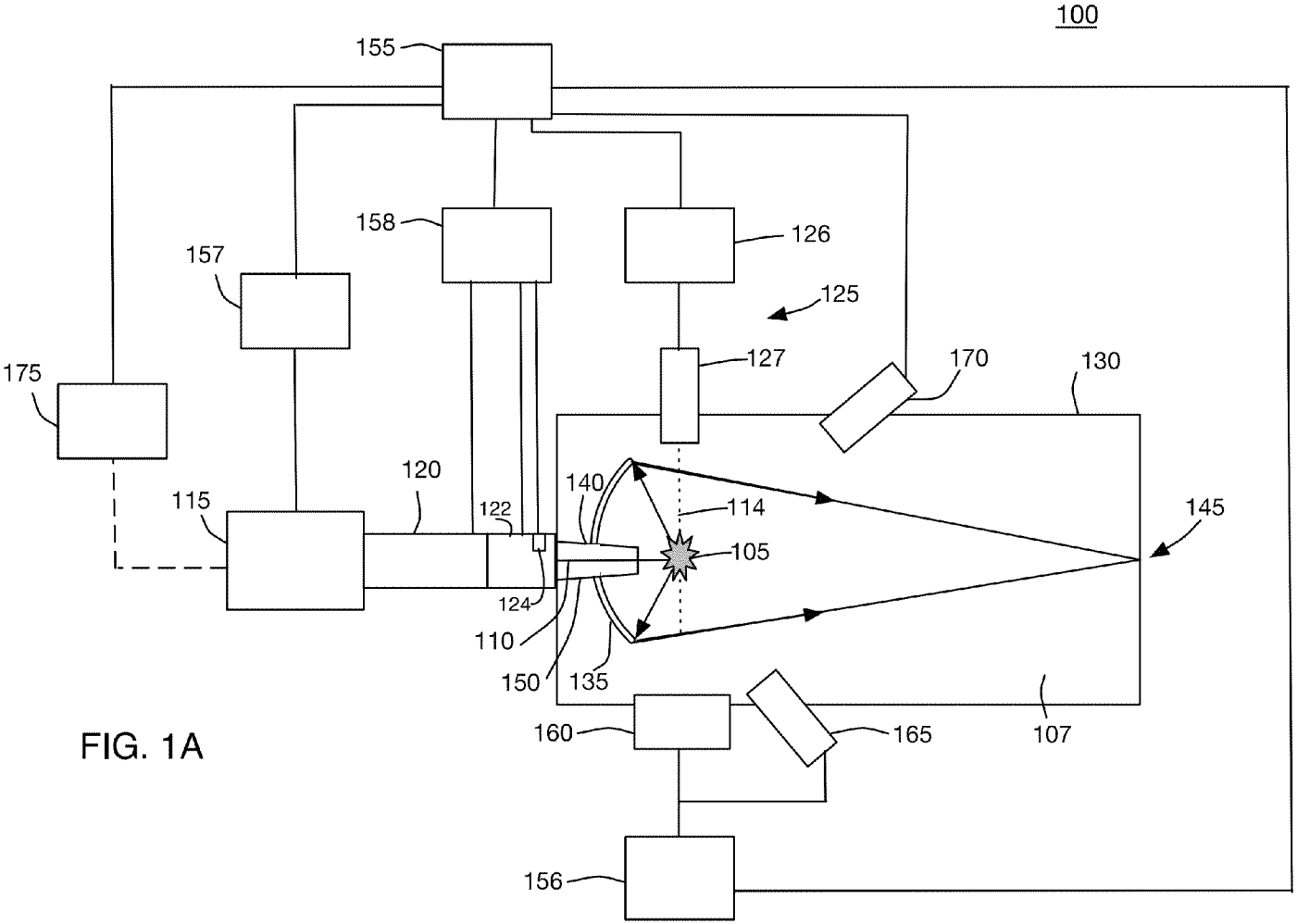
FIG. 1A is a block diagram of a laser produced plasma extreme ultraviolet light source.

Techniques for aligning or otherwise controlling the position of an amplified light beam in a laser produced plasma (LPP) extreme ultraviolet (EUV) light source based on measurements of a reflected amplified light beam are disclosed. The LPP EUV light source produces EUV light by directing an amplified light beam (an irradiating amplified light beam or a forward beam) toward a target location that receives a target material. The target material includes a material that emits EUV light when converted to plasma. When the irradiating amplified light beam strikes the target material, the target material can absorb the amplified light beam and convert to plasma and/or the target material can reflect the irradiating amplified light beam to generate the reflected amplified light beam (droplet-reflected beam or return beam).

During use of the EUV light source, the irradiating amplified light beam can move away from the target location, reducing the likelihood of converting the target material to plasma. As discussed below, the measurements of the reflected amplified light beam are used to monitor the location of the irradiating amplified light beam in multiple dimensions relative to the target material. The monitored location is used to determine adjustments to the irradiating amplified light beam so that the irradiating amplified light beam remains aligned with the target location during operation of the light source. The techniques discussed below allow monitoring of the focus position of the amplified light beam relative to the target position and control of the beam focus so that it remains at an optimal position with respect to the target position.

Multiple physical effects can cause the amplified light beam to move away from the target location. For example, heating of a focusing optic such as a lens or curved mirror that focuses the irradiating amplified light beam at the target location can change the focal length of the focusing optic and move a focal plane of the irradiating amplified light beam along a "z" direction that is parallel to the direction of propagation of the irradiating amplified light beam. Vibrations of turning mirrors and other optical elements that steer and direct the irradiating amplified light beam toward the target location can move the amplified light beam away from the target location in "x" and/or "y" directions that are transverse to the direction of propagation of the amplified light beam. For pulsed amplified light beams, a displacement between the focus position and the target material along the "x" direction, which is parallel to a path along which the droplet travels toward the target location, can indicate that the pulse is arriving in the target region before or after the target material.

To determine the location of the amplified light beam, separate sensors, having different data acquisition rates, are used to image the reflected amplified light beam, and data from the sensors is used to determine the position of the amplified light beam in multiple dimensions. Using sensors with different data acquisition rates can provide additional information because the time scales of the physical effects that cause the irradiating amplified light beam to move relative to the target location vary. For example, thermal effects on the lens that focuses the amplified light beam, such as heating of the lens material through absorption of the amplified light beam or the plasma, which cause the focal plane of the amplified light beam to move along the "z" direction occur more slowly than some movements in the "x" and/or "y" direction, which can be caused by high-frequency vibrations of optical elements.

As such, the monitoring technique discussed below can improve performance of an EUV light source by adjusting the location of the irradiating amplified light beam in multiple dimensions relative to the target location or the target material, thus improving alignment of the irradiating amplified light beam and increasing an amount of EUV light produced by the light source.

Figure 4:
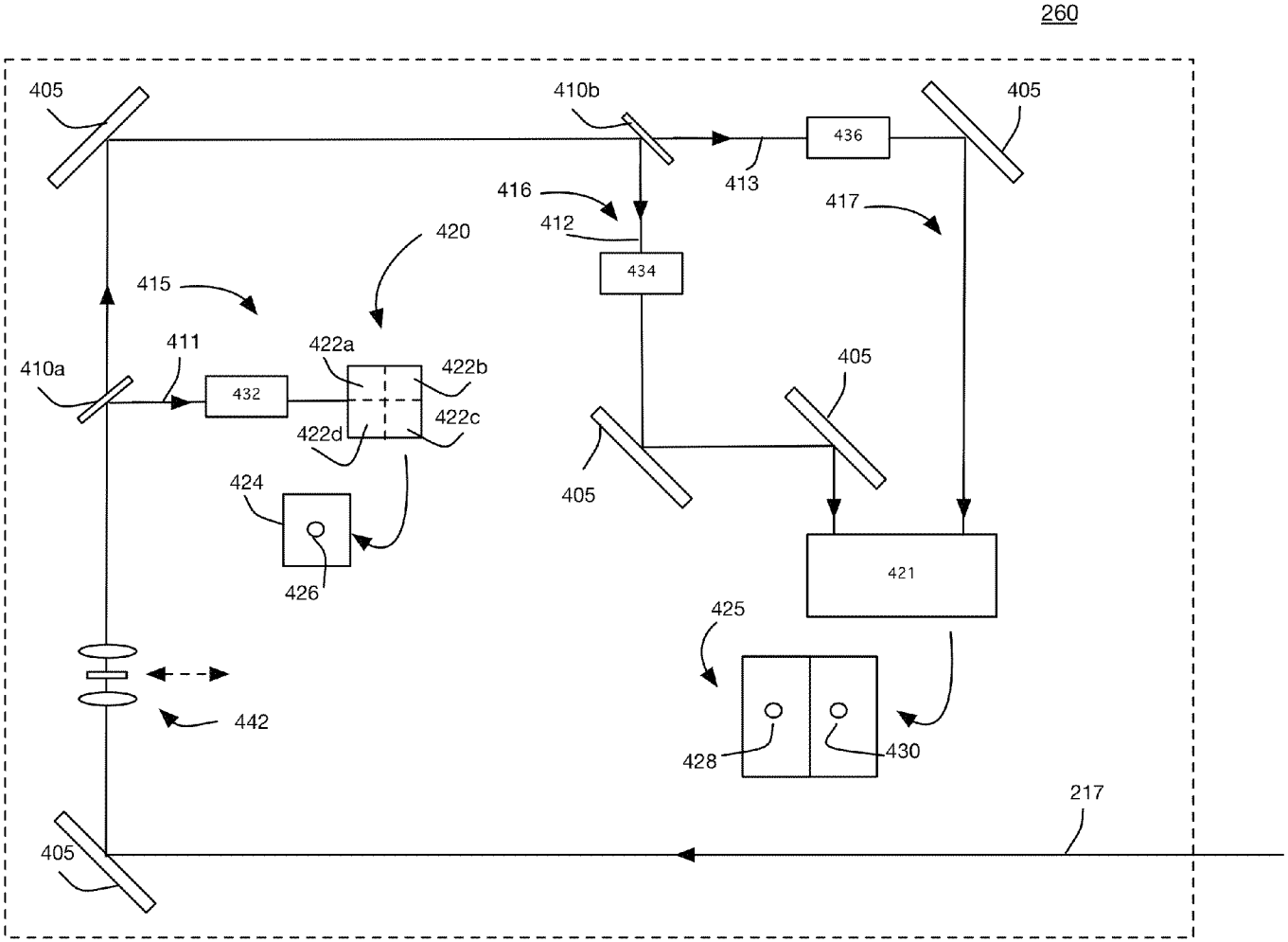
FIG. 4 is a block diagram of an example beam positioning system.

The EUV light source is discussed before discussing the monitoring techniques in more detail. FIG. 4 shows an example of a beam positioning system 260 that monitors and determines the location of the irradiating amplified light beam relative to the target material in multiple dimensions. The beam positioning system 260 also can generate signals that, when provided to actuators or other elements coupled to optical components, cause the components to change position to reposition the irradiating amplified light beam.

Referring to FIG. 1A, an LPP EUV light source 100 is formed by irradiating a target mixture 114 at a target location 105 with an amplified light beam 110 that travels along a beam path toward the target mixture 114. The target location 105, which is also referred to as the irradiation site, is within an interior 107 of a vacuum chamber 130. When the amplified light beam 110 strikes the target mixture 114, a target material within the target mixture 114 is converted into a plasma state that has an element with an emission line in the EUV range. The created plasma has certain characteristics that depend on the composition of the target material within the target mixture 114. These characteristics can include the wavelength of the EUV light produced by the plasma and the type and amount of debris released from the plasma.

The light source 100 also includes a target material delivery system 125 that delivers, controls, and directs the target mixture 114 in the form of liquid droplets, a liquid stream, solid particles or clusters, solid particles contained within liquid droplets or solid particles contained within a liquid stream. The target mixture 114 includes the target material such as, for example, water, tin, lithium, xenon, or any material that, when converted to a plasma state, has an emission line in the EUV range. For example, the element tin can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. The target mixture 114 can also include impurities such as non-target particles. Thus, in the situation in which there are no impurities, the target mixture 114 is made up of only the target material. The target mixture 114 is delivered by the target material delivery system 125 into the interior 107 of the chamber 130 and to the target location 105.

The light source 100 includes a drive laser system 115 that produces the amplified light beam 110 due to a population inversion within the gain medium or mediums of the laser system 115. The light source 100 includes a beam delivery system between the laser system 115 and the target location 105, the beam delivery system including a beam transport system 120 and a focus assembly 122. The beam transport system 120 receives the amplified light beam 110 from the laser system 115, and steers and modifies the amplified light beam 110 as needed and outputs the amplified light beam 110 to the focus assembly 122. The focus assembly 122 receives the amplified light beam 110 and focuses the beam 110 to the target location 105.

In some implementations, the laser system 115 can include one or more optical amplifiers, lasers, and/or lamps for providing one or more main pulses and, in some cases, one or more pre-pulses. Each optical amplifier includes a gain medium capable of optically amplifying the desired wavelength at a high gain, an excitation source, and internal optics. The optical amplifier may or may not have laser mirrors or other feedback devices that form a laser cavity. Thus, the laser system 115 produces an amplified light beam 110 due to the population inversion in the gain media of the laser amplifiers even if there is no laser cavity. Moreover, the laser system 115 can produce an amplified light beam 110 that is a coherent laser beam if there is a laser cavity to provide enough feedback to the laser system 115. The term "amplified light beam" encompasses one or more of: light from the laser system 115 that is merely amplified but not necessarily a coherent laser oscillation and light from the laser system 115 that is amplified and is also a coherent laser oscillation.

The optical amplifiers in the laser system 115 can include as a gain medium a filling gas that includes $CO_2$ and can amplify light at a wavelength of between about 9100 and about 11000 nm, and in particular, at about 10600 nm, at a gain greater than or equal to 1000. Suitable amplifiers and lasers for use in the laser system 115 can include a pulsed laser device, for example, a pulsed, gas-discharge $CO_2$ laser device producing radiation at about 9300 nm or about 10600 nm, for example, with DC or RF excitation, operating at relatively high power, for example, 10 kW or higher and high pulse repetition rate, for example, 50 kHz or more. The optical amplifiers in the laser system 115 can also include a cooling system such as water that can be used when operating the laser system 115 at higher powers.

Figure 1B:
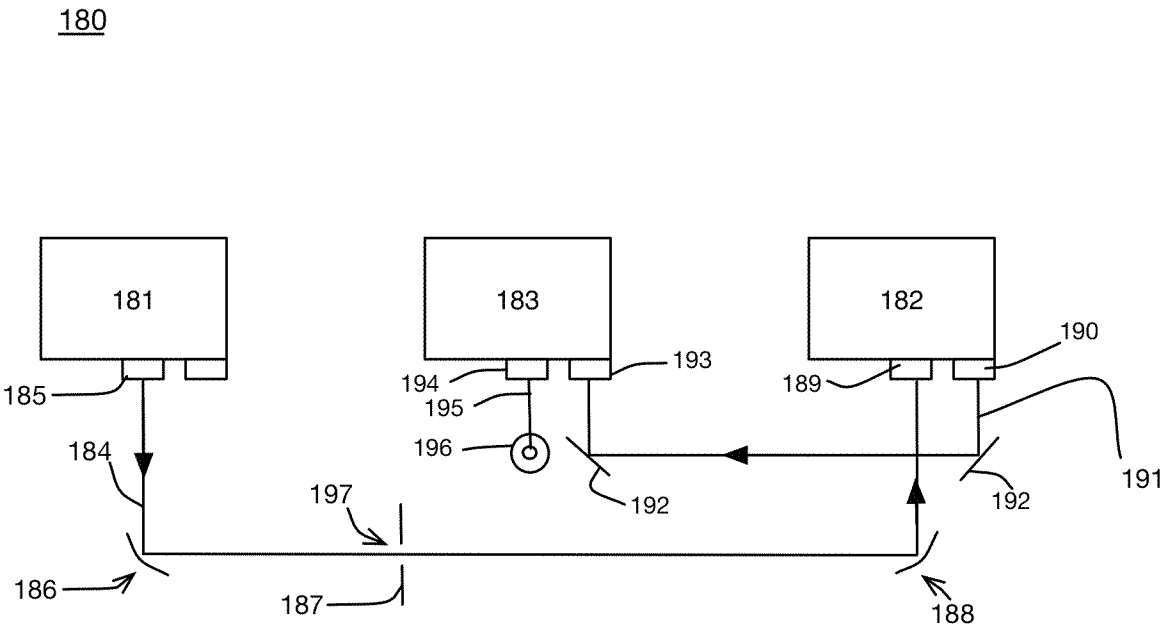
FIG. 1B is a block diagram of an example of a drive laser system that can be used in the light source of FIG. 1A.

FIG. 1B shows a block diagram of an example drive laser system 180. The drive laser system 180 can be used as the drive laser system 115 in the source 100. The drive laser system 180 includes three power amplifiers 181, 182, and 183. Any or all of the power amplifiers 181, 182, and 183 can include internal optical elements (not shown).

Light 184 exits from the power amplifier 181 through an output window 185 and is reflected off a curved mirror 186. After reflection, the light 184 passes through a spatial filter 187, is reflected off of a curved mirror 188, and enters the power amplifier 182 through an input window 189. The light 184 is amplified in the power amplifier 182 and redirected out of the power amplifier 182 through an output window 190 as light 191. The light 191 is directed toward the amplifier 183 with fold mirrors 192 and enters the amplifier 183 through an input window 193. The amplifier 183 amplifies the light 191 and directs the light 191 out of the amplifier 183 through an output window 194 as an output beam 195. A fold mirror 196 directs the output beam 195 upwards (out of the page) and toward the beam transport system 120.

The spatial filter 187 defines an aperture 197, which can be, for example, a circle having a diameter between about 2.2 mm and 3 mm. The curved mirrors 186 and 188 can be, for example, off-axis parabola mirrors with focal lengths of about 1.7 m and 2.3 m, respectively. The spatial filter 187 can be positioned such that the aperture 197 coincides with a focal point of the drive laser system 180.

Referring again to FIG. 1A, the light source 100 includes a collector mirror 135 having an aperture 140 to allow the amplified light beam 110 to pass through and reach the target location 105. The collector mirror 135 can be, for example, an ellipsoidal mirror that has a primary focus at the target location 105 and a secondary focus at an intermediate location 145 (also called an intermediate focus) where the EUV light can be output from the light source 100 and can be input to, for example, an integrated circuit beam positioning system tool (not shown). The light source 100 can also include an open-ended, hollow conical shroud 150 (for example, a gas cone) that tapers toward the target location 105 from the collector mirror 135 to reduce the amount of plasma-generated debris that enters the focus assembly 122 and/or the beam transport system 120 while allowing the amplified light beam 110 to reach the target location 105. For this purpose, a gas flow can be provided in the shroud that is directed toward the target location 105.

The light source 100 can also include a master controller 155 that is connected to a droplet position detection feedback system 156, a laser control system 157, and a beam control system 158. The light source 100 can include one or more target or droplet imagers 160 that provide an output indicative of the position of a droplet, for example, relative to the target location 105 and provide this output to the droplet position detection feedback system 156, which can, for example, compute a droplet position and trajectory from which a droplet position error can be computed either on a droplet by droplet basis or on average. The droplet position detection feedback system 156 thus provides the droplet position error as an input to the master controller 155. The master controller 155 can therefore provide a laser position, direction, and timing correction signal, for example, to the laser control system 157 that can be used, for example, to control the laser timing circuit and/or to the beam control system 158 to control an amplified light beam position and shaping of the beam transport system 120 to change the location and/or focal power of the beam focal spot within the chamber 130.

The target material delivery system 125 includes a target material delivery control system 126 that is operable in response to a signal from the master controller 155, for example, to modify the release point of the droplets as released by a target material supply apparatus 127 to correct for errors in the droplets arriving at the desired target location 105.

Additionally, the light source 100 can include a light source detector 165 that measures one or more EUV light parameters, including but not limited to, pulse energy, energy distribution as a function of wavelength, energy within a particular band of wavelengths, energy outside of a particular band of wavelengths, and angular distribution of EUV intensity and/or average power. The light source detector 165 generates a feedback signal for use by the master controller 155. The feedback signal can be, for example, indicative of the errors in parameters such as the timing and focus of the laser pulses to properly intercept the droplets in the right place and time for effective and efficient EUV light production.

The light source 100 can also include a guide laser 175 that can be used to align various sections of the light source 100 or to assist in steering the amplified light beam 110 to the target location 105. In connection with the guide laser 175, the light source 100 includes a metrology system 124 that is placed within the focus assembly 122 to sample a portion of light from the guide laser 175 and the amplified light beam 110. In other implementations, the metrology system 124 is placed within the beam transport system 120. The metrology system 124 can include an optical element that samples or re-directs a subset of the light, such optical element being made out of any material that can withstand the powers of the guide laser beam and the amplified light beam 110. A beam analysis system is formed from the metrology system 124 and the master controller 155 since the master controller 155 analyzes the sampled light from the guide laser 175 and uses this information to adjust components within the focus assembly 122 through the beam control system 158.

Thus, in summary, the light source 100 produces an amplified light beam 110 that is directed along the beam path to irradiate the target mixture 114 at the target location 105 to convert the target material within the mixture 114 into plasma that emits light in the EUV range. The amplified light beam 110 operates at a particular wavelength (that is also referred to as a source wavelength) that is determined based on the design and properties of the laser system 115. Additionally, the amplified light beam 110 can be a laser beam when the target material provides enough feedback back into the laser system 115 to produce coherent laser light or if the drive laser system 115 includes suitable optical feedback to form a laser cavity.

Figure 2A:
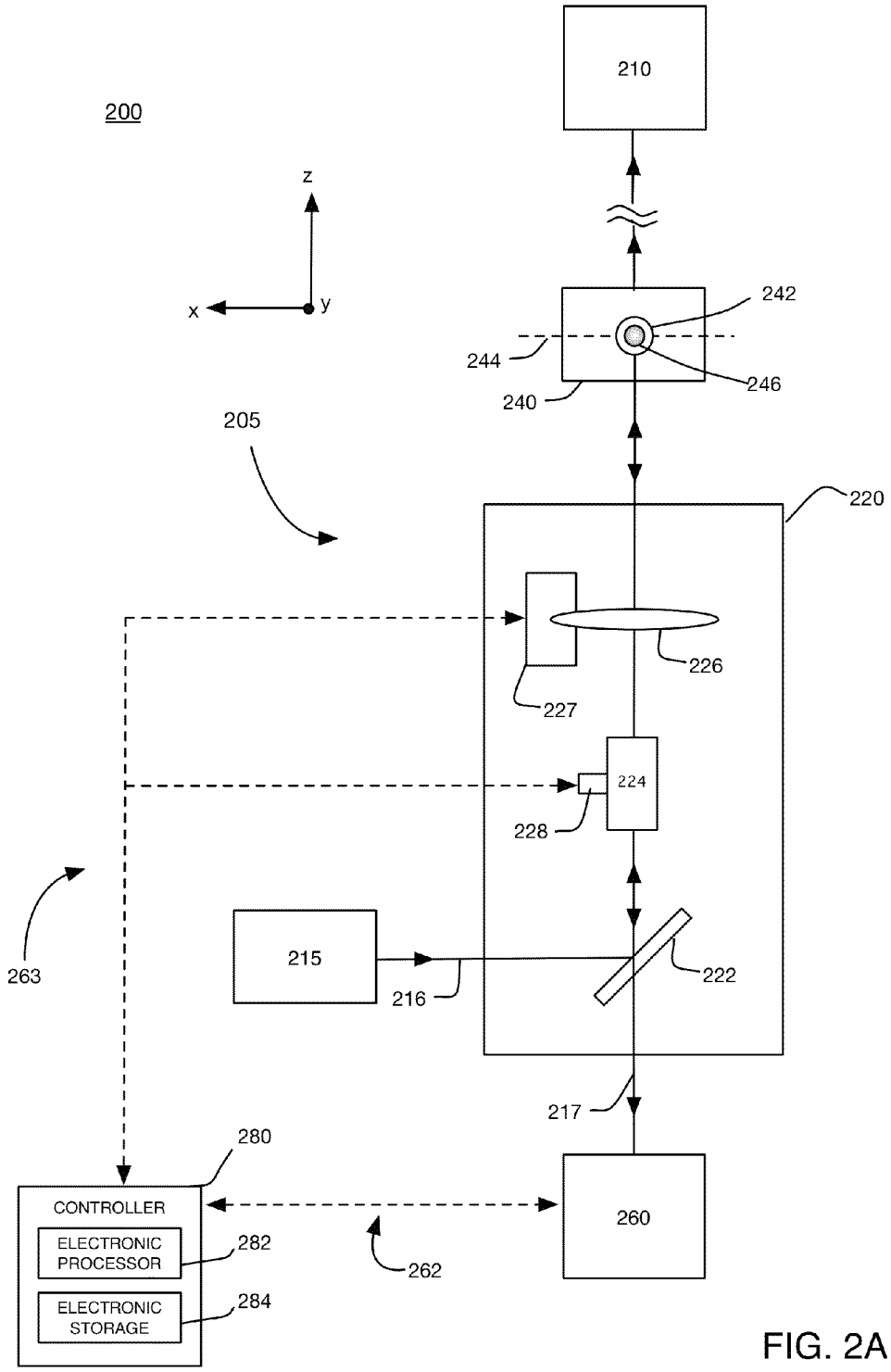
FIG. 2A is a top plan view of an example of an imaging system that includes a light source and a lithography tool.

Referring to FIG. 2A, a top plan view of an exemplary optical imaging system 200 is shown. The optical imaging system 200 includes an LPP EUV light source 205 that provides EUV light to a lithography tool 210. The light source 205 can be similar to, and/or include some or all of the components of, the light source 100 of FIGS. 1A and 1B.

As discussed in greater detail below, to increase the amount of EUV light produced by the light source 205, the light source 205 includes a beam positioning system 260 that maintains the position of an irradiating amplified light beam 216 in three dimensions relative to a target material 246 during operation of the light source 205. The beam positioning system 260 receives and measures properties of a reflected amplified light beam 217 that arises when the irradiating amplified light beam 216 is reflected from at least part of the target material 246. The measured properties are used to determine and monitor the position of the irradiating amplified light beam 216 in multiple dimensions. The beam positioning system 260 is discussed in greater detail with respect to FIG. 4.

The light source 205 includes a drive laser system 215 that produces the irradiating amplified light beam 216, a steering system 220, a vacuum chamber 240, the beam positioning system 260, and a controller 280. The steering system 220 receives the irradiating amplified light beam 216 and steers and focuses the irradiating amplified light beam toward a target location 242 in the chamber 240. The steering system 220 includes optical elements 222 and 224. In the example shown in FIG. 2A, the optical element 222 is a partially reflective optical element that receives the irradiating amplified light beam 216 and reflects the irradiating amplified light beam 216 toward the optical element 224 and the focusing system 226.

The element 224 can be a collection of optical and/or mechanical elements, such as a beam transport system, that receives the irradiating amplified light beam 216 and steers the irradiating amplified light beam 216 as needed toward the focusing system 226. The element 224 also can include a beam expansion system that expands the irradiating amplified light beam 216. Description of an exemplary beam expansion system is found in U.S. Pat. No. 8,173,985, filed Dec. 15, 2009 and titled, "Beam Transport System for Extreme Ultraviolet Light Source," which is hereby incorporated by reference in its entirety.

The focusing system 226 includes a focusing optic that receives the irradiating amplified light beam 216 and focuses the beam 216 to a focus position. The focus position is a location or region within a focal plane 244 in the chamber 240. The focusing optic can be a refractive optic, a reflective optic, or a collection of optical elements that includes both refractive and reflective optical components. The focusing system 226 also can include additional optical components, such as turning mirrors, which can be used to position the focusing optic relative to an amplified light beam that passes through the focusing optic.

Figure 2B:
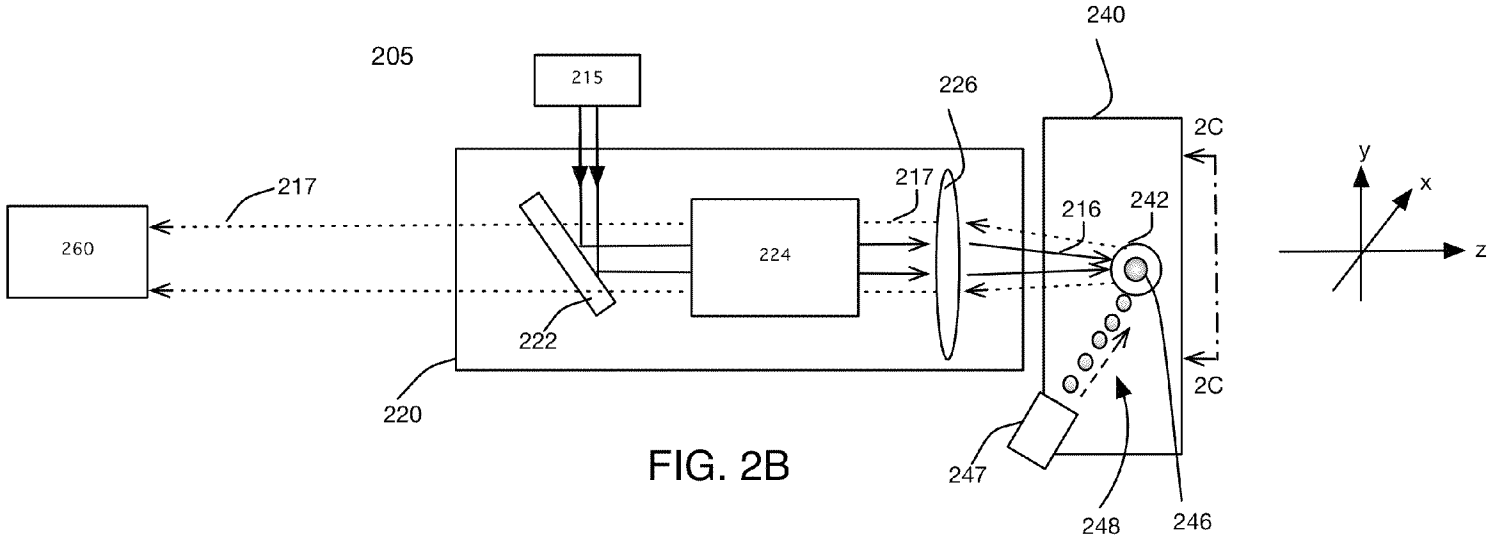
FIG. 2B is a partial side perspective view of the light source of FIG. 2A.
Figure 2C:
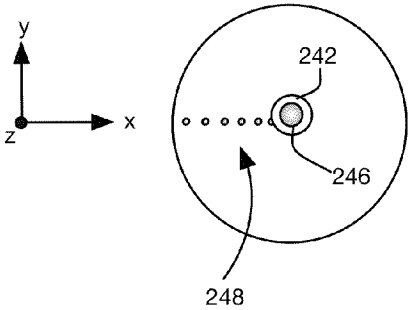
FIG. 2C is a cross-sectional plan view of the light source of FIG. 2A taken along line 2C-2C.

Referring also to FIGS. 2B and 2C, the chamber 240 receives the target material 246 at the target region 242. FIG. 2B shows a side perspective view of the light source 205, and FIG. 2C shows a cross-sectional plan view of the light source 205 along line 2C-2C. The target material 246 can be a metallic droplet that is included in a stream of target material 248 released from a target material supply apparatus 247. The stream of target material 248 is released from the target material supply apparatus 247 and travels along the "x" direction toward the target location 242. The irradiating amplified light beam 216 strikes the target material 246 and can be reflected to generate the reflected amplified light beam 217 and/or absorbed by the target material 246. The reflected amplified light beam 217 propagates away from the target region 242 in a "−z" direction opposite from the direction in which the irradiating amplified light beam 216 propagates toward the target material 246. The reflected amplified light beam 217 travels through all or part of the steering system 220 and enters the beam positioning system 260. As discussed above, EUV light is produced when the target material 246 is converted into plasma. The target material 246 is more likely to be converted to plasma when the target material 246 is in the optimal position in the beam caustic of the amplified light beam 216. The optimal position in the beam caustic is the position at which the most EUV light is produced. The optimal position can be at two points along the direction of propagation of the amplified light beam. For example, there can be two optimal locations within the beam caustic, one upstream (in the "−z" direction) of a minimal spot position and another downstream (in the "z" direction) of the minimal spot position. In another example, the optical location within the beam caustic can be at the minimal spot position, with the focus position coinciding with the target material 246.

Thus, controlling the position of the irradiating amplified light beam 216 to maintain a constant focus position with respect to the target material 246 while the light source 205 is operating can increase EUV light production by keeping the target material 246 in the optimal position. In other words, actively aligning the irradiation amplified light beam 216 relative to the target material 246 can improve performance of the light source 205.

Referring again to FIG. 2A, the beam positioning system 260 measures information that indicates the position of the irradiating amplified light beam 216, the focus position, and/or the focal plane 244 and provides the information to the controller 280 through an interface 262. The interface 262 can be any wired or wireless communication mechanism that allows for the exchange of data between the controller 280 and the beam positioning system 260. The controller 280 includes an electronic processor 282 and an electronic storage 284. The controller 280 uses the information that indicates the position of the amplified light beam 216 to generate signals that are provided to actuation systems 227 and/or 228 through an interface 263.

The electronic storage 284 can be volatile memory, such as RAM. In some implementations, and the electronic storage 284 can include both non-volatile and volatile portions or components. The processor 282 can be one or more processors suitable for the execution of a computer program such as a general or special purpose microprocessor, and any one or more processors of any kind of digital computer. Generally, a processor receives instructions and data from a read-only memory or a random access memory or both.

The electronic processor 282 can be any type of electronic processor and can be more than one electronic processor. The electronic storage 284 stores instructions, perhaps as a computer program, that, when executed, cause the processor 282 to communicate with other components in the beam positioning system 260 and/or the controller 280.

The actuation system 227 includes one or more actuators that are coupled to one or more elements of the focusing system 226. The actuators in the actuation system 227 receive signals from the controller 280 and, in response, cause the one or more elements in the focusing system 226 to move and/or change position. As a result of the change to the one or more optical elements in the focusing system 226, the location of the focal plane 244 moves in the "z" direction. For example, the measurements taken by the beam positioning system 260 may indicate that the focal plane 244 does not coincide with the target location 242. In this example, the actuation system 227 can include an actuator that is mechanically coupled to a mount that holds a lens that focuses the irradiating amplified light beam 216 to the focal plane 244. To move the focal plane 244 in the "z" direction, the actuator moves the lens in the "z" direction. The actuation system 227 also can move the focus position in the "x" or "y" direction by adjusting turning mirrors and other optical elements that can be included in the focusing system 226.

The actuation system 228 includes one or more actuators that are coupled to one or more elements of the element 224. For example, the actuation system 228 can include an actuator that is mechanically coupled to a mount that holds a fold mirror (not shown). The actuator can move the fold mirror to steer the irradiating amplified light beam 216 in a direction "x" or "y" that is transverse to the propagation direction "z."

By moving and/or repositioning the elements 224 and 226 based on the determined position of the irradiating amplified light beam 216, the location of the irradiating amplified light beam 216 is maintained relative to the location of the target material 246 to increase the amount of EUV light produced by the light source 205.

Figure 3A:
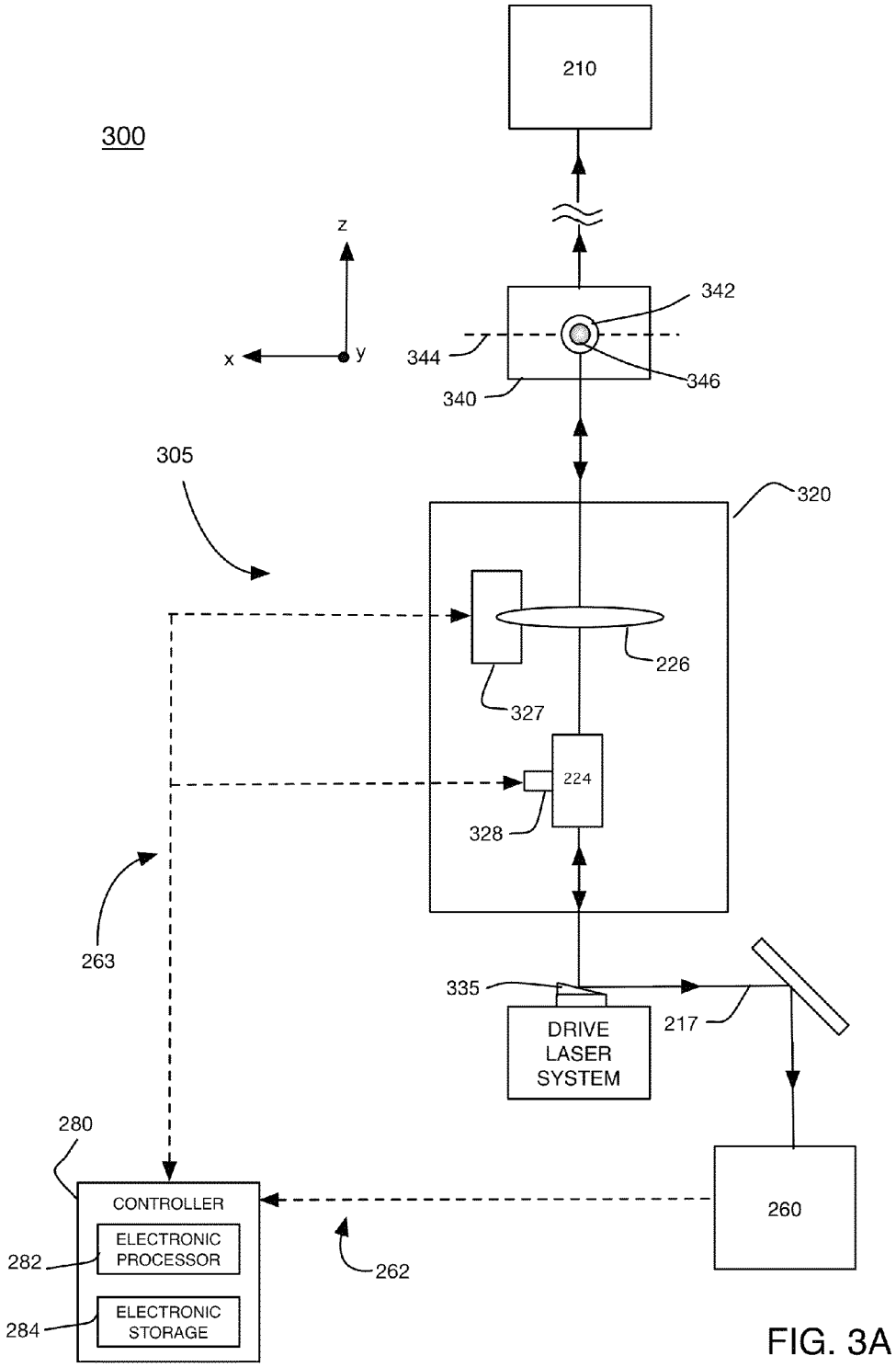
FIG. 3A is a top plan view of another example of an imaging system that includes a light source and a lithography tool.
Figure 3B:
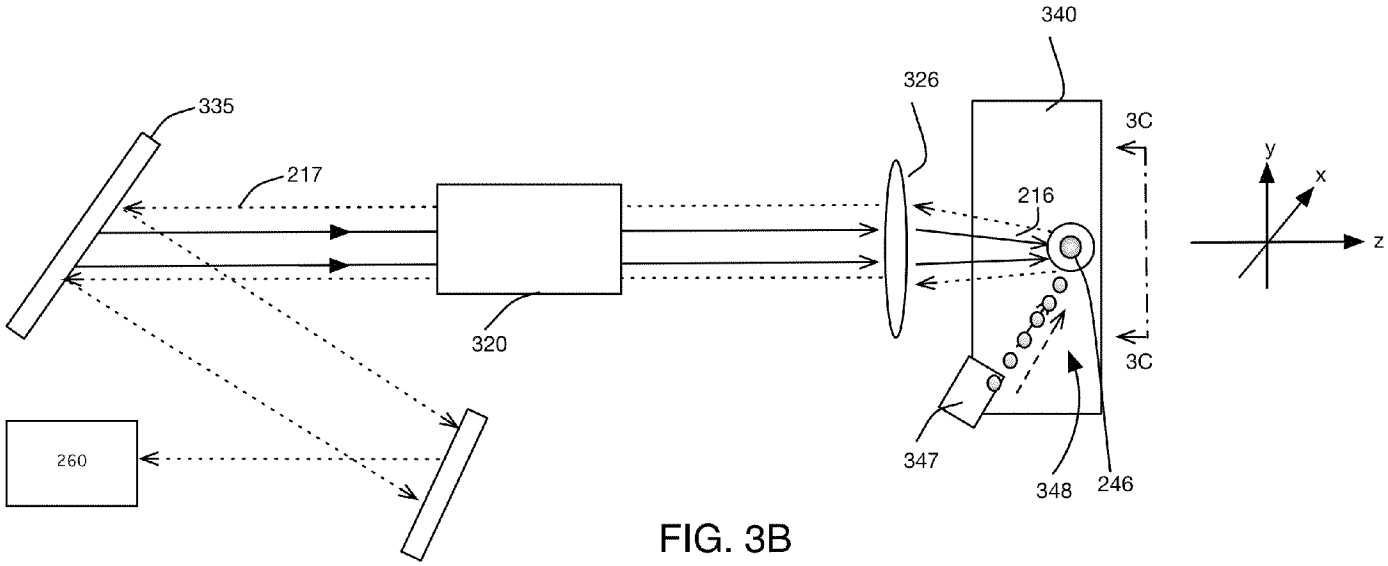
FIG. 3B is a partial side perspective view of the light source of FIG. 3A.
Figure 3C:
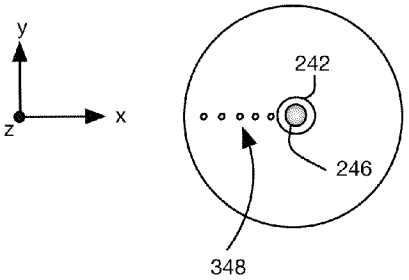
FIG. 3C is a cross-sectional plan view of the light source of FIG. 3A taken along line 3C-3C.

Referring to FIGS. 3A-3C, another example of an imaging system is shown. FIG. 3A shows a top plan view of an exemplary imaging system 300. FIG. 3B shows a side perspective view of the imaging system 300, and FIG. 3C shows a cross-sectional plan view of the imaging system 300 taken along line 3C-3C. The imaging system 300 is similar to the imaging system 200.

The imaging system 300 includes a light source 305 and the EUV lithography tool 210. The light source 305 includes a steering system 320 that receives the irradiating amplified light beam 216 from the drive laser system 215. The steering system 320 is similar to the steering system 220, except that the steering system 320 does not include the optical element 222 to direct the reflected amplified light beam 217 to the beam positioning system 260. Instead, the reflected amplified light beam 217 is reflected off of a window 335 of the drive laser system and onto an optical element 340. The optical element 340 directs the reflected amplified light beam 217 to the beam positioning system 260. The optical element 340 can be, for example, a flat mirror or a curved mirror. The window 335 can be a window on a power amplifier that is part of the drive laser system 215. For example, the reflected amplified light beam 217 can reflect off of the window 194 of the amplifier 183 (FIG. 1B).

Referring to FIG. 4, a block diagram of an example of the beam positioning system 260 is shown. The beam positioning system 260 receives the reflected amplified light beam 217, separates the reflected amplified light beam 217 into multiple channels, and measures characteristics of the reflected amplified light beam 217 in each channel. The characteristics of the reflected light beam 217 are used to determine the location of the irradiating amplified light beam 216 relative to the target material 246 in multiple dimensions. The first, second, and third channels 415-417 can be paths along which light propagates in free space. In some implementations, the channels 415-417 also can include components that guide and at least partially contain the light that propagates in the channels, such as fiber optics and other waveguides.

The beam positioning system 260 includes fold mirrors 405 and partially reflective optical elements 410*a* and 410*b*. The partially reflective optical elements 410*a* and 410*b* can be, for example, beam splitters or partially reflective mirrors. The fold mirrors 405 steer the reflected amplified light beam 217 through the beam positioning system 260. The partially reflective optical element 410*a* receives the reflected amplified light beam 217 reflects a portion of the beam 217 into the first channel 415. The partially reflective optical element 410*b* receives the transmitted portion of the beam 217 and reflects a portion of the light into the second channel 416. The partially reflective optical element 410*b* transmits the remainder of the reflected amplified light beam 217 into the third channel 417.

Thus, a portion of the reflected amplified light beam 217 travels in the first channel 415, the second channel 416, and the third channel 417. The portion of the reflected amplified light beam 217 that travels in the first channel 415 is the beam 411, the portion that travels in the second channel 416 is the beam 412, and the portion that travels in the third channel is the beam 413.

The beam positioning system 260 also includes a sensor 420 and a sensor 421. The sensor 420 is positioned to sense the beam 411, and the sensor 421 is positioned to sense the beam 412 and the beam 413. Data from the sensor 420 can be used to produce an image 424 that includes a representation 426 of the beam 411. Data from the sensor 421 can be used to produce an image 425 that includes a representation 428 of the beam 412 and a representation 430 of the beam 413. The location of the focal plane 244 (FIGS. 2A and 2B) and/or focus position relative to the target material 246 can be determined in multiple dimensions by analyzing the shape of the representations 426, 428, and 430 and/or the position of the representations 426, 428, and 430.

The sensors 420 and 421 acquire data at different rates, and, thus, provide information about physical effects that occur on different time scales. In the example shown, the sensor 420 has a higher data acquisition rate than the sensor 421. The sensor 420 can have an acquisition rate that is similar to, or the same as, the repetition rate of the drive laser 215. In some implementations, the sensor 420 has an acquisition rate of at least about 50 kHz or a data acquisition rate of about 63 kHz. The high acquisition rate allows the sensor 420 to collect data that can be used to monitor high-frequency system disturbances and occurrences, such as mirror vibrations in the beam transport system 224 or variations in the trajectory of the target material stream 114, that can cause rapid changes in the location of the irradiating amplified light beam 216 in directions that are transverse to the direction of propagation of the irradiating amplified light beam 216. The dimensions that are transverse to the direction of propagation of the irradiating amplified light beam 216 include the "x" and "y" directions shown in FIGS. 2A and 2B. The changes in the location of the irradiating amplified light beam 216 in the transverse direction cause corresponding changes in the location of the reflected amplified light beam 217, and these changes can be measured by the sensor 420.

The sensor 421 has a lower data acquisition rate than the sensor 420 and can provide relatively more information than the sensor 420. The sensor 421 can have a data rate of, for example, about 48 Hz. The sensor 421 can be any sensor that is sensitive to the wavelengths included in the reflected amplified light beam 217. For example, the sensor 421 can be a PYROCAM camera available from Ophir-Spiricon, LLC of North Logan, Utah. Although the example shown in FIG. 4 includes a single sensor 421 that produces a the image 425, in other implementations, separate sensors can be used for each of the second channel 416 and the third channel 417, and each of the separate sensors can produce a separate image having a representation of the light that travels in the respective channel.

Figure 5A:
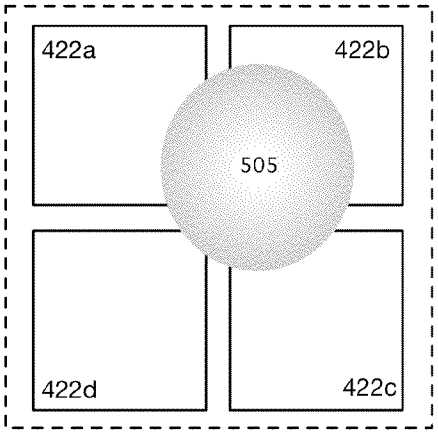
FIGS. 5A-5C are exemplary images of a reflected beam that forms a spot on a quadrant sensor.
Figure 5B:
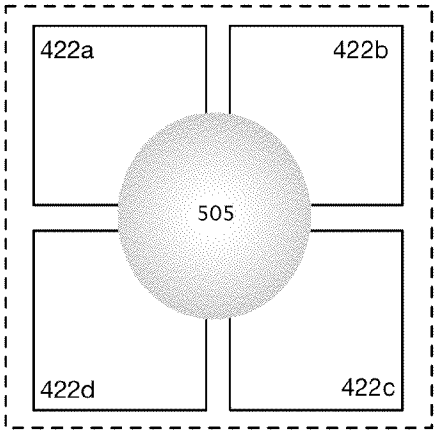
Figure 5C:
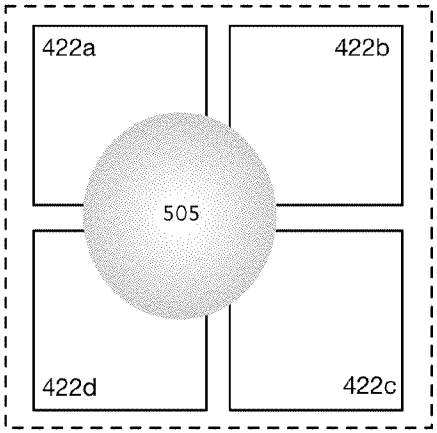

The beam positioning system 260 also includes optical elements in each of the channels 415, 416, and 417. The channel 415 includes an optical element 442 that can include, for example, a lens or other element that focuses the beam 411 onto the sensor 420. Referring also to FIGS. 5A-5C, the sensor 420 in the example of FIG. 4 is a quadrant sensor that includes multiple, separate sensing elements 422*a*-422*d* that are arranged in a square array. To measure the position of the beam 411 on the sensor 420, the amount of energy sensed at each of the sensing elements 422*a*-422*d* is measured. An example of determining the position of the beam 411 on the sensor is discussed below with respect to FIG. 16.

To ensure that the position of the reflected amplified light beam 217 is measured accurately, the diameter of the beam 411 at the sensor 420 is larger than the diameter of any one of the sensing elements 422*a*-422*d* but smaller than the diameter of the square array defined by the sensing elements 422*a*-422*d*. In this configuration, the beam 411 tends to fall on more than one of the sensing elements 422*a*-422*d* of the sensor 420. To make a relatively large diameter beam on the sensor 420, the optical element 432 can be positioned so that the beam 411 is not focused on the sensor 420. In other words, the optical element 432 can be positioned in a defocused state so that the sensor 420 detects the beam 411, but the beam 411 is not focused onto the sensor 420. In some implementations, the optical element 432 can include one or more optical elements that expand the light to make a relatively larger spot on the sensor 420.

Figure 7:
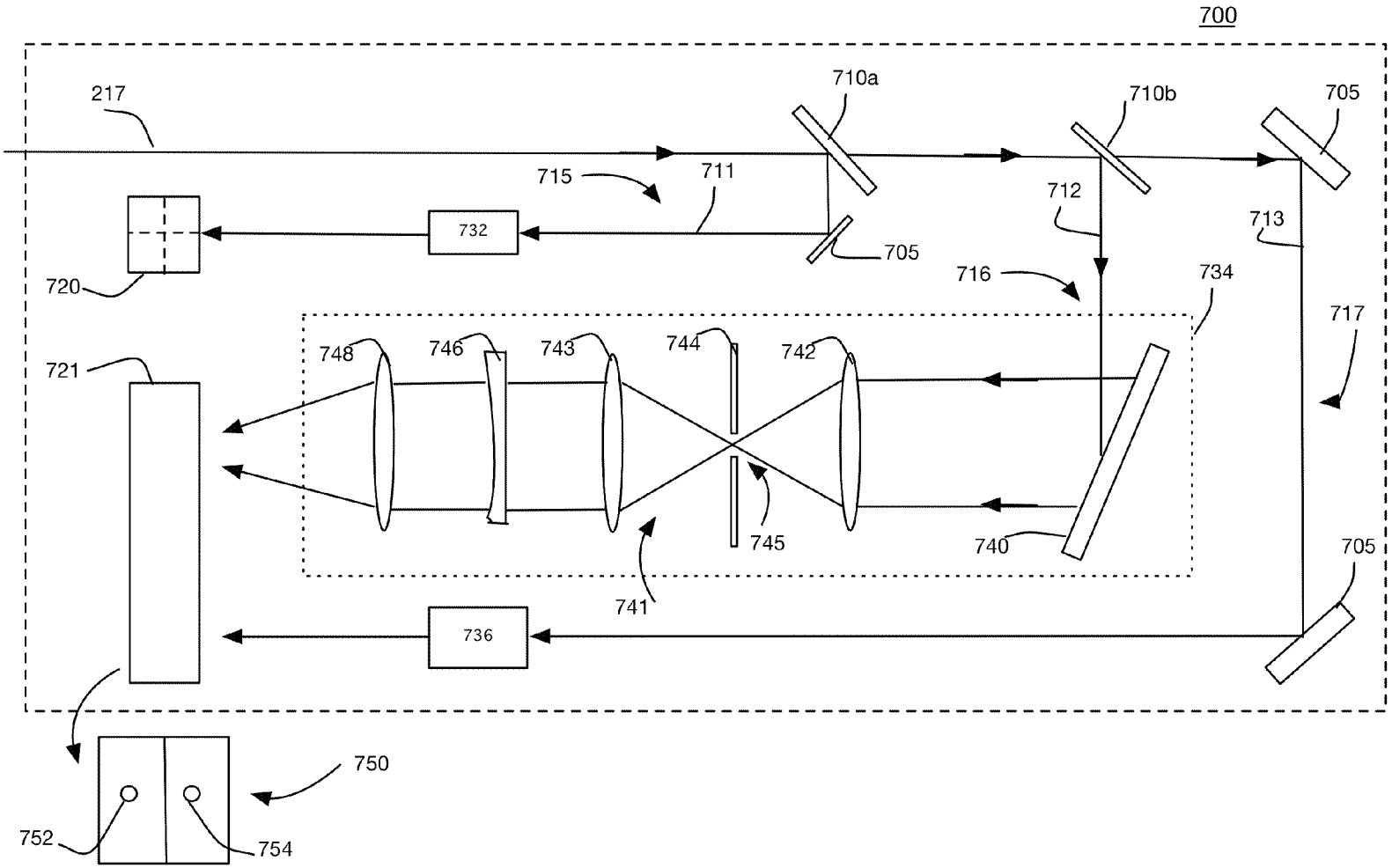
FIG. 7 shows a block diagram of another exemplary beam positioning system.

The beam positioning system 260 also includes the optical element 434 positioned in the channel 416. The optical element 434 is positioned in the channel 416 between the partially reflective optical element 410*b* and the sensor 421. The optical element 434 receives and transmits the light that is reflected from the optical element 410*b* so that the location of the focal plane 244 or focus position can be determined in the "z" direction. The optical element 434 can include an astigmatic optical element that modifies the focus of the wavefront and changes the elipticity of the representation 428 when the focal plane 244 moves in the "z" direction. An example of an implementation in which the optical element 434 includes an astigmatic optical element is shown in FIG. 7.

Figure 12:
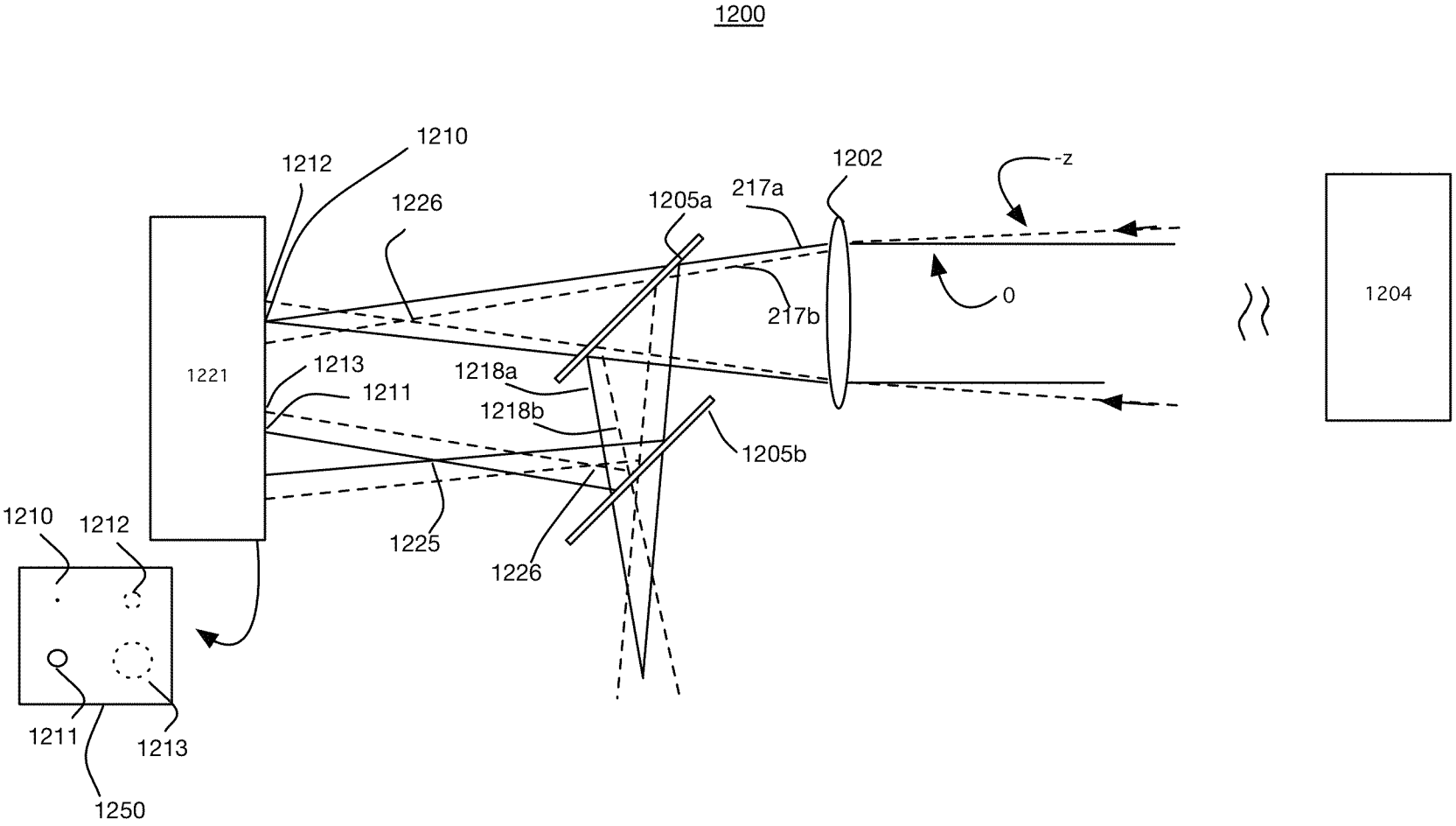
FIGS. 12 and 14 show block diagrams of exemplary optical assemblies.
Figure 14:
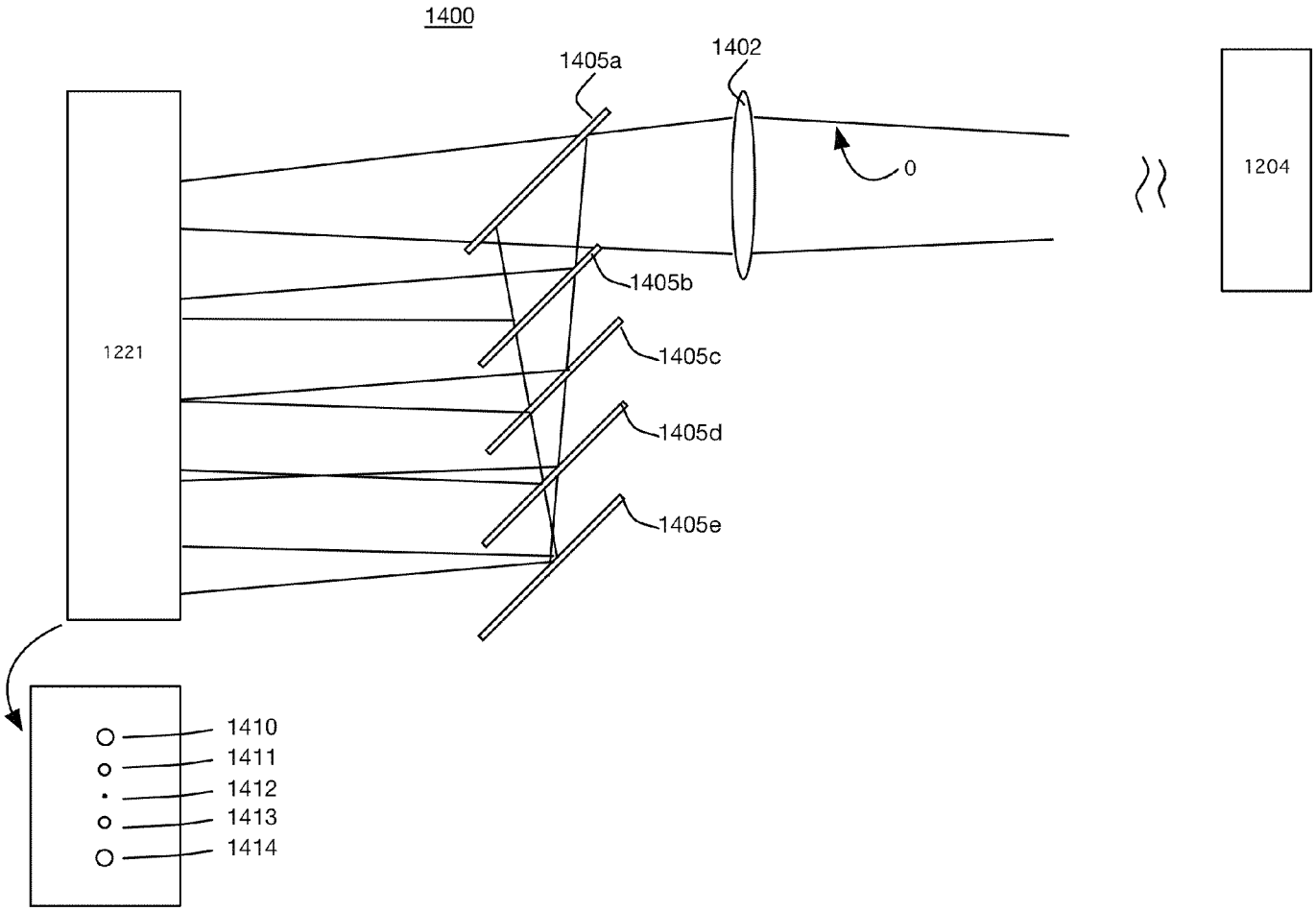

In some implementations, the optical element 410*b* includes a collection of optical elements, none of which are astigmatic, that provide paths of different lengths for the reflected amplified light beam 217 to propagate from the target material 246 to the sensor 421. In these implementations, measuring the size of the beam diameter of the reflected amplified light beam 217 provides an indication of the location of the focal plane 244 and the shape of the focus caustic in the "z" direction. An example of an implementation of the optical element 436 that does not include an astigmatic optical element is shown in FIGS. 12 and 14.

The beam positioning system 260 also includes the optical element 436 that is positioned between the optical element 410*b* and the sensor 421. The optical element 436 receives and directs the beam 413 toward the sensor 421. The light sensed by the sensor 421 is used to form the representation 430. Along with the measurement of the location of the reflected amplified light beam 217 on the sensor 420, the location of the representation 430 provides a second indication of the location of the irradiating amplified light beam 216 relative to the target material 246 in a dimension that is transverse to the direction of propagation of the irradiating amplified light beam 216.

As such, the beam positioning system 260 provides multiple measurements of position and/or shape of the reflected amplified light beam 217. The system 260 provides two measurements, one from the sensor 420 that a relatively high data acquisition rate and the other from the sensor 421 that has a lower data acquisition rate, that can be used to locate the irradiating amplified light beam 216 relative to the target material 246 in dimensions that are transverse ("x" or "y") to the direction of propagation of the irradiating amplified light beam 216. The system 260 also provides measurements that can be used to locate the focal plane 244 or focus position relative to the target material 246 in the direction of propagation of the irradiating amplified light beam 216.

The beam positioning system 260 also can include a spectral filter 442 that is removable from the beam path. The spectral filter transmits some wavelengths while blocking others. In some implementations, two different pulsed irradiating amplified light beams are directed toward the target material 246. These two irradiating amplified light beams are referred to as a main pulse and a pre-pulse. The main pulse and the pre-pulse are separated in time, with the pre-pulse being directed toward the target material 246 before the main pulse. The pre-pulse and the main pulse can have different wavelengths. For example, the pre-pulse can have a wavelength of about 1.06 μm and the main pulse can have a wavelength of about 10.6 μm. In cases where the irradiating amplified light beam 216 includes a pre-pulse and a main pulse, the reflected amplified light beam 217 can include reflections of the main pulse and the pre-pulse.

When placed to receive the reflected amplified light beam 217, the spectral filter 442 separates the pre-pulse from the main pulse, allowing the beam positioning system 260 to use either or both of the pre-pulse and the main pulse to determine a location of the irradiating amplified light beam 216 relative to the target location 242. In some instances, the pre-pulse can provide a tighter focus spot and more accurate results than the main beam.

Referring to FIGS. 5A-5C, examples of the beam 411 on the sensor 420 are shown. The beam 411 travels through the channel 415 to the sensor 420, where the beam 411 forms a spot 505. When the irradiating light beam 216 is aligned with the target material 246, the beam 411 falls in the center of the sensor 420 and equal amounts of energy are sensed by each of the sensing elements 422*a*-422*d*. When the irradiating amplified light beam 216 is misaligned relative to the target material 246 in a transverse dimension ("x" or "y" as shown in FIGS. 2A-2C), the spot 505 is a distance from the center of the sensor 420 that corresponds to the misalignment of the irradiating amplified light beam 216.

FIGS. 5A-5C show the spot 505 at three different times. In FIGS. 5A and 5C, the spot 505 is off-center, indicating that the irradiating amplified light beam 216 is misaligned in a transverse direction relative to the target location 242. In FIG. 5B, the spot 505 is in the center of the sensor 420, indicating that the irradiating amplified light beam 216 is aligned with the target location in a transverse direction. As discussed above, the variation of the location of the spot 505 on the sensor 420 indicates high-frequency changes in the location of the irradiating amplified light beam 216.

Figure 6:
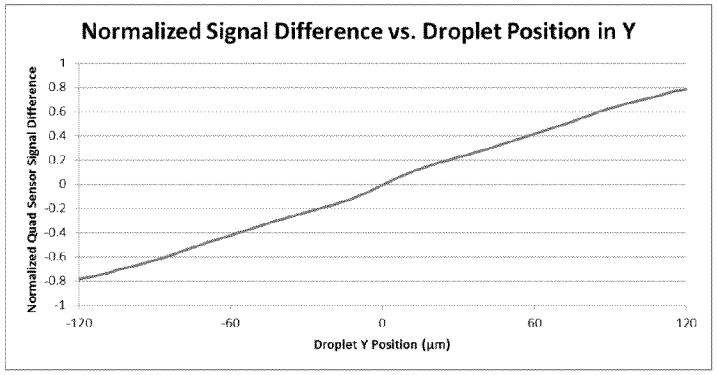
FIG. 6 is an exemplary graph of the response of a quadrant sensor as a function of a distance between an irradiating amplified light beam and a target material.

Referring to FIG. 6, an example of the difference in the amount of energy on the sensing elements 422*a*-422*d* as a function of the transverse distance between the target material 246 and the focus position is shown. FIG. 6 shows the response of the sensor 420 when the target material 246 is moved in the vertical plane (the "y" direction shown in FIG. 2A) relative to the irradiating amplified light beam 216.

Referring to FIG. 7, a block diagram of another exemplary beam positioning system is shown. The beam positioning system 700 can be used with the light source 100, 205, or 305 instead of the system 260. The beam positioning system 700 includes astigmatic optics to measure the location of the focus position relative to the target material 246.

The beam positioning system 700 includes fold mirrors 705 and partially reflective optics 710*a* and 710*b*. The partially reflective optics 710*a* and 710*b* can be, for example, beam splitters or partially reflective mirrors. The beam positioning system 700 receives the reflected amplified light beam 217 and divides the beam 217 into three separate channels 715, 716, and 717. The reflected amplified light beam 217 strikes the partially reflective optic 710*a* and a portion (a beam 711) is reflected into the first channel 715. The first channel 715 is also referred to as fast transverse channel. A fold mirror 705 directs the beam 711 toward the optical element 732, and the optical element 732 directs and/or focuses the beam 711 onto a sensor 720. The optical element 732 is similar to the optical element 432 (FIG. 4), and the sensor 720 is a quadrant sensor 720 similar to the sensor 420 (FIG. 4).

The partially reflective optic 710*b* receives the portion of the return beam 217 that the reflective optic 710*a* transmits. The portion of the return beam 217 that the reflective optic 710*b* transmits enters the third channel 717 as beam 713. The third channel 717 is referred to as the "slow transverse channel." The fold mirrors 705 direct the beam 713 through the third channel 717 to optics 736, which focus and/or direct the beam 713 to the sensor 721. Data collected by the sensor 721 can be used to generate an image 750 that includes a spot 752 that represents the beam 712 and a spot 754 that represents the beam 713.

The partially reflective optic 710*b* reflects a portion into the channel 716 as beam 712. The channel 716 is referred to as the "slow z channel." The partially reflective optic 710*b* directs the beam 712 to optical assembly 734, which focus and direct the beam 712 to a sensor 721. The sensor 721 is similar to the sensor 421 (FIG. 4). The beam 712 enters and passes through the components of the optical assembly 734, exits the optical assembly 734 and is sensed by the sensor 421. The beam 712 forms a spot on the sensor 421.

The optical assembly 734 includes a flat reflective element 740, a spatial filter 741, an astigmatic optical element 746, and a lens 748. The flat reflective element 740 can be a flat mirror. The astigmatic optical element 746 can be, for example, a cylindrical lens or mirror, a collection of cylindrical lenses and mirrors, or a biconic mirror.

The beam 712 enters the optical assembly 734 and is reflected from the flat reflective element 740 into the spatial filter 741. The spatial filter 741 includes a lens 742, a lens 743, and an aperture 744. The aperture 744 defines an opening 745 that is placed at the focal point of the lens 742, and the aperture 744 filters the beam 712 before it reaches the sensor 721. Passing the beam 712 through the opening 745 helps to remove background radiation and scatter from the beam 712. The flat mirror 705 used with the spherical optics 736 allows the position of the focus to be measured in the "x" and or "y" directions more precisely than a channel that includes cylindrical or astigmatic optics.

The lens 743 collimates the beam 712 and directs the beam to the astigmatic optical element 746. After passing through the astigmatic optical element 746, the beam 712 passes through the lens 748 and forms a spot on the sensor 721. Because the optical assembly 734 includes an astigmatic element, the ellipticity of the spot changes as the focus position of the irradiating amplified light beam 216 moves in the direction of propagation relative to the target material 246.

Figure 8A:
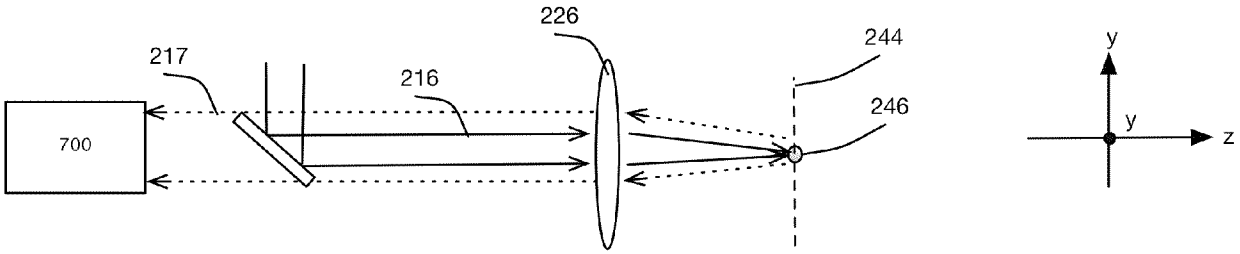
FIGS. 8A-8C show side views of an irradiating amplified light beam relative to a target material.
Figure 8B:
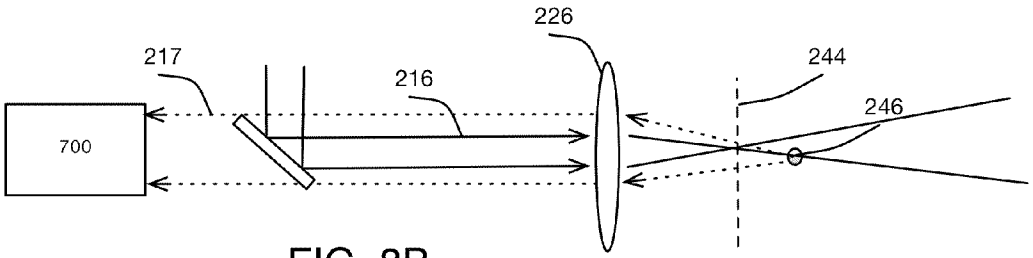
Figure 8C:
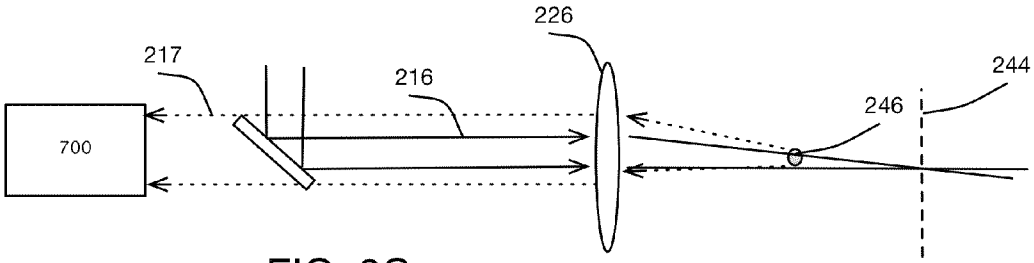
Figure 9A:
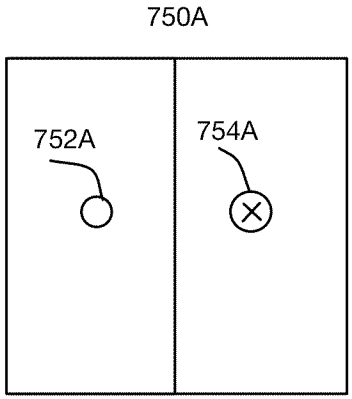
FIGS. 9A-9C are examples of images from a sensor that images two reflected beams.
Figure 9B:
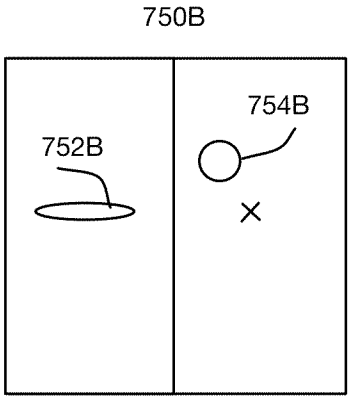
Figure 9C:
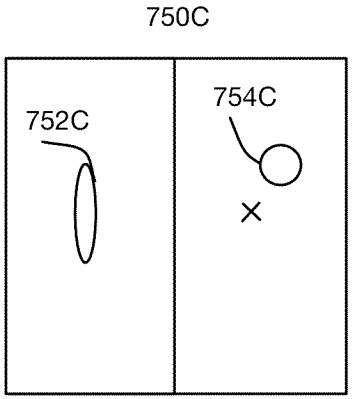

Referring to FIGS. 8A-8C and 9A-9B, examples of various relative placements of the focal plane 244 and the target material 246 and example images generated by the sensor 721 are show. FIGS. 8A-8C show an example of the focus position moving in the "z" and "y" directions due to, for example, thermal heating and/or motion in optical components in the optical components. FIGS. 9A-9C show exemplary images 750A-750C, respectively, generated from data collected by the sensor 721.

In the beam positioning system 700, the beam 712 travels through the channel 716 and is received by the sensor 721. The beam 713 travels through the channel 717 and is received by the sensor 721. The optical components of the channels 716 and 717 are aligned such that the light from the channel 716 falls on the left side of the sensor 721, and the light from the channel 717 falls on the right side of the sensor 721. Thus, the left side of the images 750A-750C shows a representation of the beam 712, and the right side of the images 750A-750C shows a representation of the beam 713.

The image 750A of FIG. 9A shows an image produced by the sensor 721 when the sensor 721 monitors a scenario similar to that of FIG. 8A, in which the focal plane 244 coincides with the target material 246. In this instance, there is no displacement between the target material 246 and the focus position in the "z" or "y" directions and the irradiating amplified light beam 216 is aligned with the target material 246. The image 750A indicates the aligned state because the representation 752A of the beam 712 (which passes through the optical assembly 734 and the astigmatic optical element 746) is circular. Additionally, the representation 754A of the beam 713 coincides with the center of the right side of the sensor 721, indicating that the irradiating amplified light beam 216 coincides with the target material 246 in the "y" direction shown in FIG. 8A.

The image 750B of FIG. 9B shows an image produced by the sensor 721 when the sensor 721 monitors a scenario similar to that of FIG. 8C. In this instance, the target material 246 is displaced from the focus position in the "z" and "−y" directions. The image 750B indicates this misalignment with the ellipticity of the representation 752B and the location of the representation 754B on the sensor 751. In particular, the horizontal axis of the representation 752B is wider than the vertical axis, indicating that the focal position is displaced in the "−z" direction relative to the target material 246. The representation 754B of the beam 713 has moved to the left compared to the representation 754A, indicating that the target material 246 is displaced in the "−y" direction relative to the target material 246.

The image 750C of FIG. 9C shows an image produced by the sensor 721 when the sensor monitors a scenario similar to that of FIG. 9C. In this instance, the target material 246 is behind and below the focus position. The image 750C indicates this misalignment with the ellipticity of the representation 752C and the location of the representation 754C on the sensor 751. In particular, the vertical axis of the representation 752C of the beam 712 is wider than the horizontal axis, indicating that the target material 246 is displaced from the focus position in the "−z" direction. The representation 754C indicates that the target material 246 is displaced in the "y" direction relative to the target material 246.

Figure 10B:
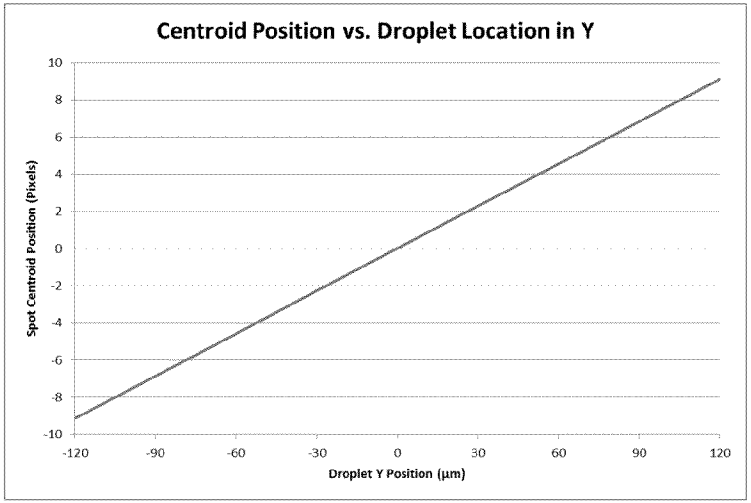
FIGS. 10A and 10B are exemplary graphs of sensor response as a function of a distance between an irradiating amplified light beam and a target material.
Figure 10A:
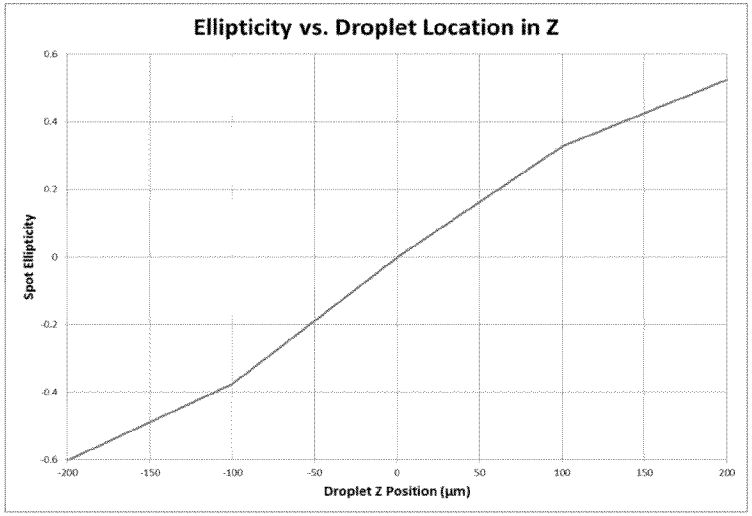

FIG. 10A shows an example of the ellipticity of the representation of the beam 712 as a function of the position of the target material 246 in the "x" direction. The ellipticity is 0 when the focus position of the irradiating amplified light beam 216 coincides with the target material 246. Such a scenario is shown in FIGS. 8A and 9A. The ellipticity is negative (the horizontal axis is greater than the vertical axis) when the focus position forms before reaching the target material 246, as shown in FIGS. 8B and 9B. The ellipticity is positive (the horizontal axis is smaller than the vertical axis) when the focus position forms after the target material 246, as shown in FIGS. 8C and 9C.

FIG. 10B shows an example of the centroid position of the representation of the beam 713 as a function of the position of the target material 246 in the "y" direction. When the centroid is to the left of the center of the right side of the sensor 721, the centroid can be considered to have a negative value and the target material 246 is located in the "−y" direction relative to the focus position (FIG. 8B). When the centroid is to the right of the center of the right side of the sensor 721, the target material 246 is located in the "y" direction relative to the focus position (FIG. 8C).

Figure 11:
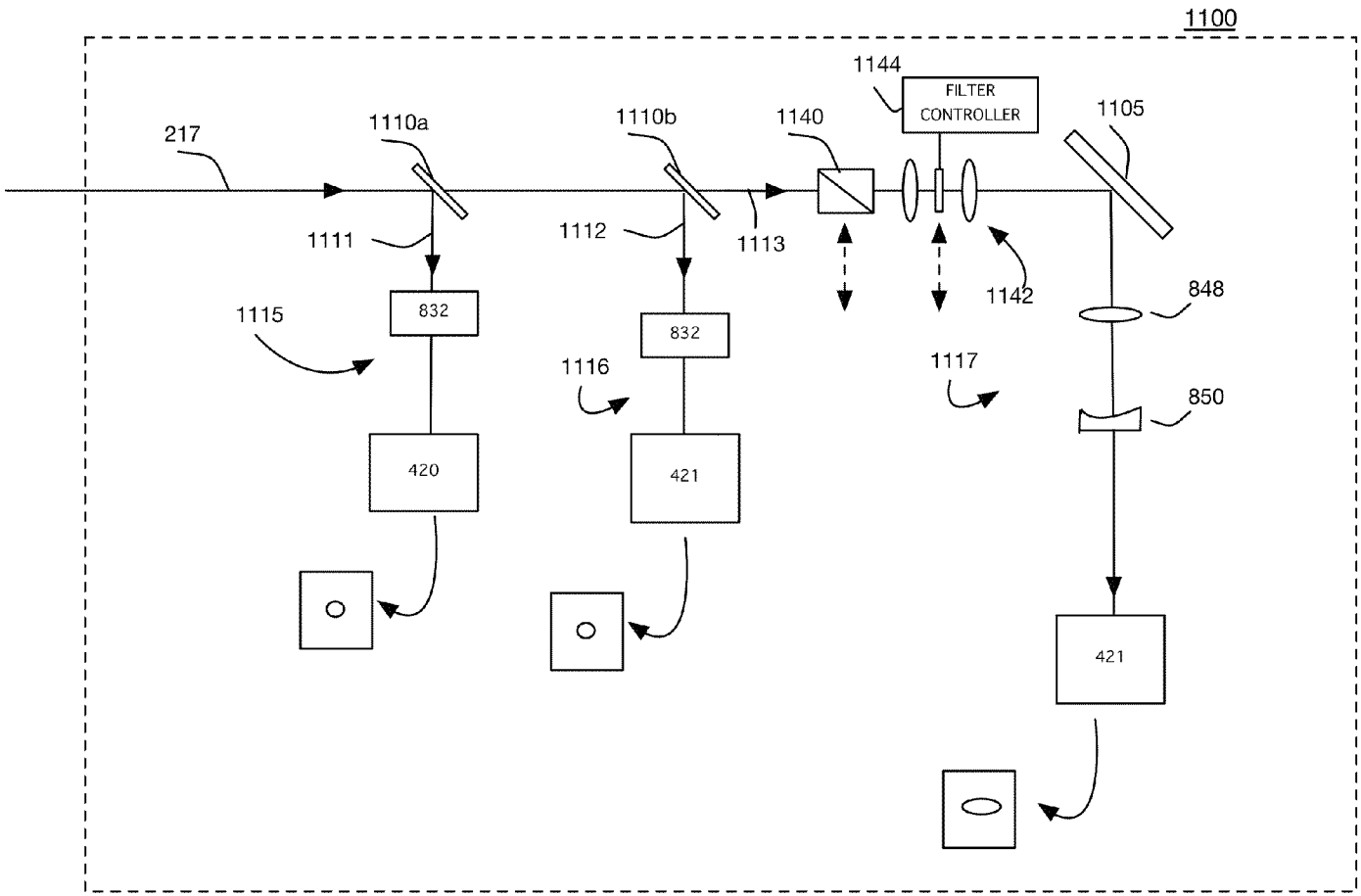
FIG. 11 shows a block diagram of another exemplary beam positioning system.

FIG. 11 is a block diagram of another exemplary beam positioning system 1100. The beam positioning system 1100 can be used with the light source 205 or 305 instead of the beam positioning system 260 or the beam positioning system 700. The beam positioning system 1100 includes three channels through which the reflected amplified light beam 217 travels, and the beam positioning system 1100 provides data that is used to locate the irradiating amplified light beam 216 in multiple dimensions relative to the target material 246. The beam positioning system 1100 includes one or more astigmatic optical elements in a channel that is used to locate the irradiating amplified light beam 216 in a direction that is parallel to the direction of propagation of the irradiating amplified light beam 216 (the "z" direction shown in FIG. 2B).

The beam positioning system 1100 also includes a spectral filter 1142. The spectral filter 1142 is similar to the spectral filter 442 discussed with respect to FIG. 4. The beam positioning system 1100 receives the reflected amplified light beam 217. The reflected amplified light beam 217 strikes a partially reflective optical element 1110*a*, and a portion of the reflected amplified light beam 217 is reflected into a channel 1115. The portion of the reflected amplified light beam 217 that is reflected into the channel 1115 is the beam 1111. The beam 1111 passes through optics 1132 to the sensor 1120. The optics 1132 can be similar to the optical element 432 (FIG. 4) and the sensor 1120 can be the quadrant detector 420 discussed with respect to FIG. 4.

The portion of the reflected amplified light beam 217 that is transmitted by the partially reflective optical element 1110*a* is divided into beams 1112 and 1113 by a partially reflective optical element 1110*b*. The beam 1112 travels in the channel 1116, and the beam 1113 travels in the channel 1117. The channel 1116 includes optics 1134, and the beam 1112 passes through the optics 1134 to a sensor 1121. The optical element 1134 can be similar to the optics 434.

The channel 1117 includes the polarizer 1140, the spectral filter 1142, which is coupled to a filter controller 1144, a flat reflective element 1146, a lens 1148, and an astigmatic optical element 1150. The polarizer 1140 and the spectral filter 1142 can be removed from the channel 1117. When the polarizer 1140 and the spectral filter 1142 are not in the channel 1117, the beam 1113 does not pass through these elements. The spectral filter 1142 can be a spectral filter that transmits light in a first wavelength band and blocks light in a second wavelength band. The first wavelength band can include the wavelengths of the pre-pulse, and the second wavelength band can include the wavelengths of the main pulse. In this example, the spectral filter 1142 transmits the pre-pulse and blocks the main pulse. The spectral filter 1142 can include multiple spectral filters, one that blocks the pre-pulse and transmits the main pulse, and another spectral filter that blocks the main pulse and transmits the pre-pulse. The filter controller 1144 is used to remove the spectral filter 1142 from the channel 1117 and to place the spectral filter 1142 in the channel 1117. In implementations in which the spectral filter 1142 includes more than one filter, the filter controller 1144 allows selection of one of the more than one filter to be placed in the channel 1117.

The beam 1113 exits the astigmatic optical element 1150 and is sensed by a sensor 1152. The sensor 1152 and the sensor 1121 have a lower data acquisition rate than the sensor 1120. The sensors 1152 and the sensor 1121 can be PYROCAM cameras available from Ophir-Spiricon, LLC of North Logan, Utah. In some implementations, the beams 1112 and 1113 can be directed to a similar location so that only one sensor (either the sensor 1152 or the sensor 1121) is needed.

Referring to FIG. 12, another exemplary optical assembly 1200 for a beam positioning system is shown. The optical assembly 1200 can be used in the beam positioning system 260 as the optical element 434, in the beam positioning system 700 instead of the optical assembly 734, or in the beam positioning system 1100 in channel 1117.

The optical assembly 1200 provides information that can be used to determine the position of the focus position relative to the target material 246 in the direction of propagation of the irradiating amplified light beam 216. The optical assembly 1200 does not include astigmatic optical elements. Instead, the optical assembly 1200 employs multiple non-astigmatic optical elements to create a series of optical paths, each having a different length, between the target material 246 and a sensor 1221. The portion of the return beam 217 that travels in each path is imaged onto the sensor 1221. Because the paths have different lengths, the image of a beam that follows a particular path is an image of a cross-section of the irradiating amplified light beam 216 at a particular location along the direction of propagation. By analyzing a series of images of beams that follow different paths, the location of the focus position relative to the target material 246 can be determined and adjusted if needed.

The optical assembly 1200 includes a lens 1202 and partially reflective optics 1205*a* and 1205*b*. The optical assembly 1200 receives the return beam 217 from the light source 1204 (which can be similar to the light source 205 or 305). For illustration, FIG. 12 shows two instances of the return beam 217 that occur at different times. A return beam 217*a* is a reflected amplified light beam that arises when the irradiating amplified light beam 216 is focused onto the target location 242. The second return beam shown in FIG. 12 is the beam 217*b*. The return beam 217*b* arises when the irradiating amplified light beam 216 comes to a focus before reaching the target material 246. Referring also to FIGS. 13A and 13B, a side view of a light source with the irradiating amplified light beam 216 focused on the target material is illustrated in FIG. 13A. A side view of a light source with the irradiating amplified light beam 216 focused before reaching the target material 246 is shown in FIG. 13B.

The beam 217*a* travels through the lens 1202 and is transmitted and reflected by the partially reflective optical element 1205*a*. The transmitted portion of the beam 217*a* forms a spot 1210 on the sensor 1221. The reflected portion of the beam 217*a* is shown as beam 1218*a*. The beam 1218*a* is reflected and transmitted by the reflective optical element 1205*b*. The portion of the beam 217*a* reflected by the optical element 1205*b* forms a spot 1211 on the sensor 1221. The beam 217*b* travels through the lens 1202 and is transmitted and reflected by the partially reflective optical element 1205*a*. The transmitted portion of the beam 217*b* forms a spot 1212 on the sensor 1221. The reflected portion of the beam 217*b* (beam 1218*b*) is reflected and transmitted by the reflective optical element 1205*b*. The portion of the beam 217*b* reflected by the optical element 1205*b* forms a spot 1212 on the sensor 1221.

As shown in the image 1250, the lens 1202 brings the beam 217*a* to a focus at the sensor 1221. Thus, the spot 1210 has a small diameter. The beam 1218*a* follows a longer path to the sensor 1221 and comes to a focus at a point 1225, before reaching the sensor 1221. The beam 1218*a* begins to diverge after the point 1225 and the spot 1211 has a larger diameter than the spot 1210.

The lens 1202 focuses the beam 217*b* to a point 1226 before the beam 217*b* reaches the sensor 1221. The beam 217*b* begins to diverge before reaching the sensor 1221. Thus, the spot 1221 that the beam 217*b* forms on the sensor has a larger diameter than it would if the beam 217*b* was in focus at the sensor 1221. The path that the beam 1218*b* follows to the sensor 1221 is longer and the focal point 1226 occurs further away from the sensor 1221. As such, the spot 1213 formed by the beam 1218*b* has a larger diameter than the spot 1212.

By comparing the diameter of the spots 1212 and 1213, it is determined that the beam 217*b* is converging, and that the focal plane 244 and focus position of the irradiating amplified light beam 216 occurs before (in the "−z" direction) the target material 246. The focal plane 244 can be adjusted to move toward the target material 246 along the direction of propagation or the target material 246 can be moved toward the location of the focal plane 244.

Referring also to FIG. 13C, an example in which the amplified light beam 216 has a focus position after (in the "+z" direction) the target material 246, the reflected amplified light beam 217 is diverging, and the spot 1213 has a larger diameter than the spot 1212. Thus, the focus position of the amplified light beam 216 can be adjusted to move closer to the expected location of the target material 246. In other words, the focus position of the amplified light beam 216 can be moved toward the target location 247 by moving the focus position in the "−z" direction.

Referring to FIG. 14, an example of another optical assembly 1400 is shown. The optical assembly 1400 is similar to the optical assembly 1200, except the optical assembly 1400 includes five partially reflective optical elements 1405*a*-1405*e*. The optical assembly 1400 can be used in a beam positioning system in place of the optical assembly 1200.

The partially reflective optical elements 1405*a*-1405*e* each provide a path of a different length from the target material 246 to the sensor 1221 and create corresponding spots 1410-1414 on the sensor 1221. In the example shown in FIG. 14, a lens 1402 focuses a collimated return beam 217, which arises when the focus position of the irradiating amplified light beam 216 coincides with the target material 246, to a spot 1412 on the sensor 1221. Thus, the spot 1410, which is a measure of a different cross-section of the return beam 217 than the spot 1412, has a larger diameter. In this example, the spot 1412 has the smallest diameter of the spots 1410-1414.

By comparing the diameters of the spots 1410-1414, the location of the focus position of the amplified light beam 216 relative to the target material 246 (or target location 242) can be determined. For example, if the smallest diameter spot is the spot 1410, the focus of the irradiating amplified light beam 216 can be adjusted to, for example, move toward the target material 246 along the direction of propagation or the target material 246 can be moved toward the location of the focal plane 244 and focus position. If the smallest diameter spot is the spot 1414, the focus of the irradiating amplified light beam 216 can be adjusted to move away from the target material 246.

Although the example of FIG. 12 shows two partially reflective optical elements 1205*a* and 1205*b*, and the example of FIG. 14 shows five partially reflective topical elements 1205*a*-1205*e*, other numbers of reflective optical elements can be used.

Figure 14B:
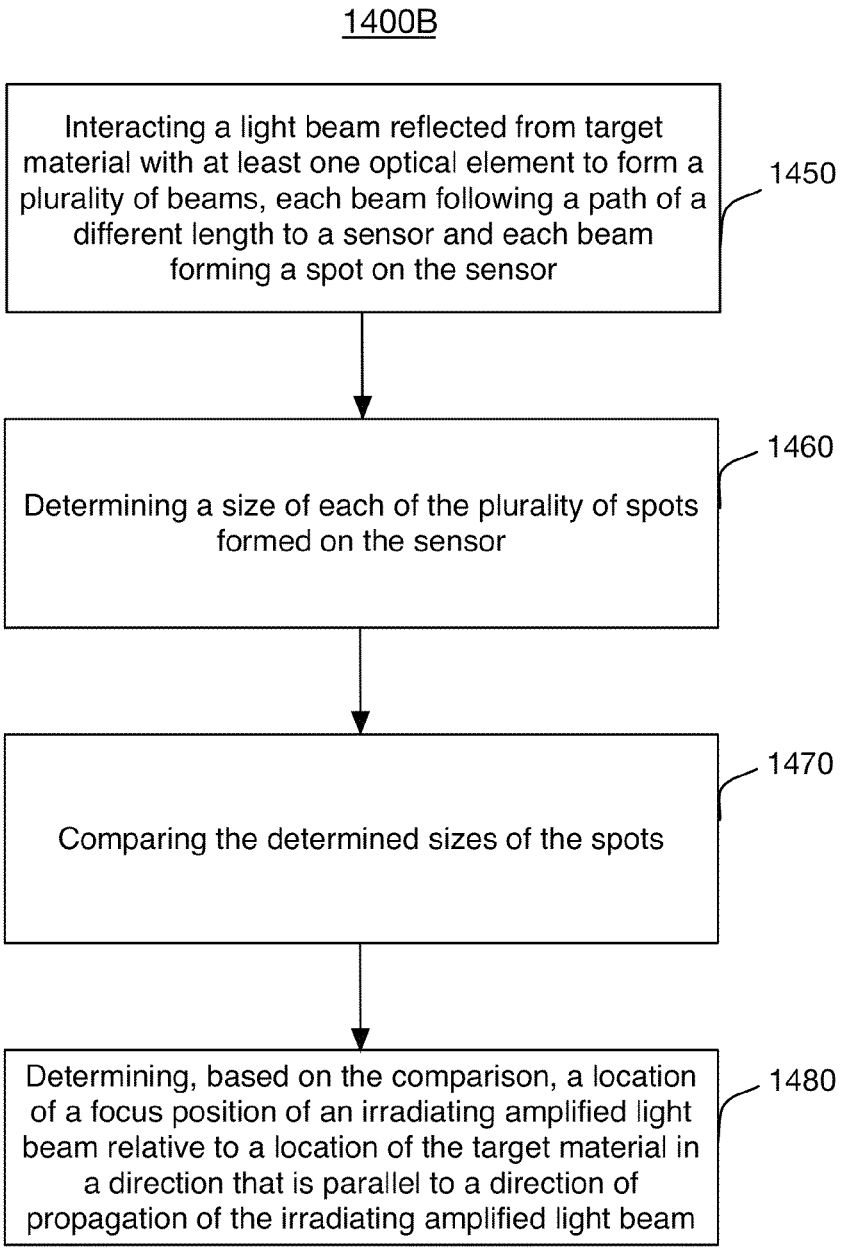
FIG. 14B is a flow chart of an exemplary process for adjusting a focus position relative to a target material.

FIG. 14B shows an example process 1400B for adjusting a focus position of the amplified light beam 216 using a non-astigmatic optical assembly such as the assembly 1200 or 1400. The process 1400B can be performed on data collected with the assembly 1200 or 1400 alone or with the assembly 1200 or 1400 as part of any of the beam positioning systems 260, 700, or 1100. The process 1400B can be performed by the controller 280 and/or by an electronic processor in one or more of the sensors in the beam positioning system. In the discussion below, the process 1400 is discussed with respect to the beam positioning system 260, the assembly 1400, and the sensor 1221.

The return beam 217 is interacted with at least one optical element to form a plurality of beams, each beam following a path of a different length to the sensor 1221 and each beam forming a spot 1410-1414, respectively, on the sensor 1221 (1450). Interacting the return beam 217 with at least one optical element can include passing the return beam 217 through the lens 1402 to focus the return beam 217. In other implementations, interacting the return beam 217 with at least one optical element can include reflecting the return beam 217 from a reflective element, such as a curved mirror, that focuses the return beam 217.

Interacting the return beam 217 with at least one optical element includes passing the return beam 217 through at least one partially reflective element to form a plurality of beams. Each of the beams follows a path of a different length from the target material 246 and/or the lens 1202 to the sensor 1221 and forms a spot on a different portion of the sensor 1221 (as shown in FIG. 12). For example, as shown in FIG. 12, five reflective elements can be used to divide the return beam 217 into five beams, each following a path of a different length to the sensor 1221. More or fewer reflective elements can be used. The reflective elements can be, for example, beam splitters, partially reflective mirrors, or any other optical element that splits a beam into two or more beams that propagate along different paths.

Each of the plurality of beams forms a spot on the sensor 1221. The diameter of the spot varies because of the different path lengths between the lens 1402 and the sensor 1221 for each of the plurality of beams. Because of the varying path lengths to the sensor 1221, the spots 1410-1414 on the sensor 1221 can be considered samples of the cross-section of the beam taken at different planes along the direction of propagation. Comparing the relative sizes of the spots 1410-1414 provides an indication of the location of the focus of the irradiating amplified light beam 216 relative to the target material 246 in the direction of propagation of the irradiating light beam 216.

A size of each of the plurality of spots 1410-1414 is determined (1460). The size can be, for example, a diameter of the spot or an area of the spot. The determined sizes are compared (1470). A location of the focus position of the amplified light beam 216 is determined based on the comparison (1480). For example, the sensor 1221, the reflective elements 1405*a*-1405*e*, and the lens 1402 can be arranged relative to each other such that if the focus position of the amplified light beam 216 overlaps the target material 246 such that the return beam is collimated when it passes through the lens 1402, the return beam 217 is focused at the spot 1412. In this example, if the spot 1411 is measured as being smaller than the spot 1412, the focus position of the amplified light beam 216 does not overlap the target material 246. For example, the return beam 217 can be converging instead of collimated, which can indicate that the focus position of the amplified light beam 216 should be moved toward the target location 242 in the "+z" direction. Other implementations can have the optical components of the light source 1204 arranged in a different configuration. For example, in other implementations, a converging return beam 217 can indicate that the amplified light beam 216 should be moved in the "−z" direction relative to the target location 242.

To position the focus position of the irradiating amplified light beam 216 in the "z" direction (the direction of propagation of the beam 216), one or more actuators in the actuation systems 228 and 227 move mirrors, lenses, and/or mounts within the beam transport system 224 and/or focusing system 226 (FIG. 2A) to steer the irradiating amplified light beam 216 toward the target material 246. In implementations in which the process 1200B is performed completely or partially by or with the controller 280, the location of the focus position can be provided to or calculated by the controller 280, and the controller 280 can produce a signal corresponding to an amount for the components within the transport system 224 and/or focusing system 226 to move or adjust to adjust the location of the focus of the amplified light beam 216.

Figure 15A:
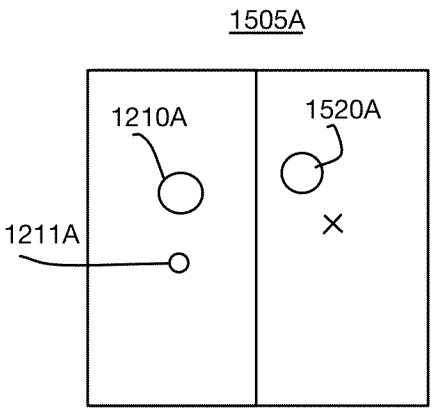
FIGS. 15A-15C are examples of images from a sensor that images two reflected beams.
Figure 15B:
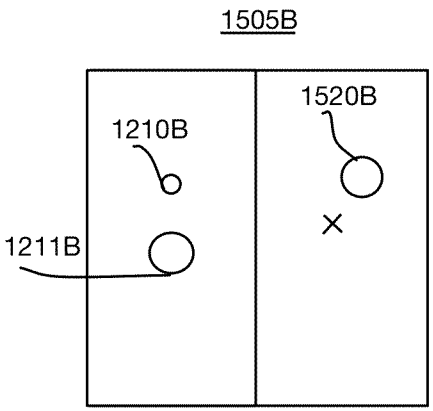
Figure 15C:
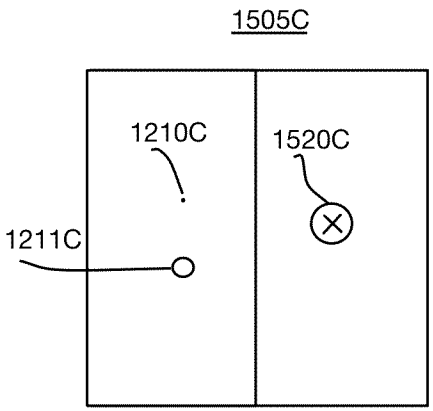

Referring to FIGS. 15A-15C, exemplary images created from a sensor that images two channels of a beam positioning system that includes the optical assembly 1200 are shown. The beam positioning system can be any of the beam positioning systems 260, 700, or 1100, with the optical assembly 1200 being used in channel 316, 716, or 1116, respectively. Images 1505A-1505C show an image of the sensor at three different times as the focus position of the irradiating amplified light beam 216 moves relative to the target material 246. The left side of the images 1505A-1505C shows spots 1210 and 1211. Referring also to FIG. 12, spot 1210 is the spot created when the return beam 217 passes through the lens 1202 before reaching the sensor 1221. Spot 1211 is the spot created with the return beam 217 passes through the lens 1202 and is reflected off of the partially reflective optical elements 1205*a* and 1205*b* before reaching the sensor 1221.

In the image 1505A, the spot 1210A has a larger diameter than the spot 1211A, indicating that the focus position of the irradiating amplified light beam 216 occurs before reaching the target material 246. In the image 1505B, the spot 1210B has a smaller diameter than the spot 1211B, indicating that the focus position of the irradiating amplified light beam 216 occurs after reaching the target material 246. Thus, an adjustment to the focus position made on the basis of the image 1505A was in the proper direction, but the focus position does not overlap the target material 246. In the image 1505C, the spot 1210C is point-like, indicating that the lens 1202 focuses the beam 217 onto the sensor 1221, and, thus, the irradiating amplified light beam 216 is focused on the target material.

The right side of the images 1505A-1505C shows a spot 1520A-1520C that is an image of the portion of the return beam 217 that travels through the channel 317, 717, or 1116. Similar to the right side of the images 905A-905C (FIGS. 9A-9C), the spots 1520A-1520C show the movement of the irradiating amplified light beam 216 relative to the target material 246 in a direction that is transverse to the direction of propagation of the irradiating amplified light beam 216. Image 1505A shows that the irradiating amplified light beam 216 is above the target material 246 in the vertical plane (the "y" direction in FIG. 2A), and image 1505B shows that the irradiating amplified light beam 216 is below the target material 246 in the vertical plane (the "−y" direction in FIG. 2B). At the time represented in the image 1505C, the irradiating amplified light beam 216 overlaps with the target material 246 in the vertical plane.

Figure 16:
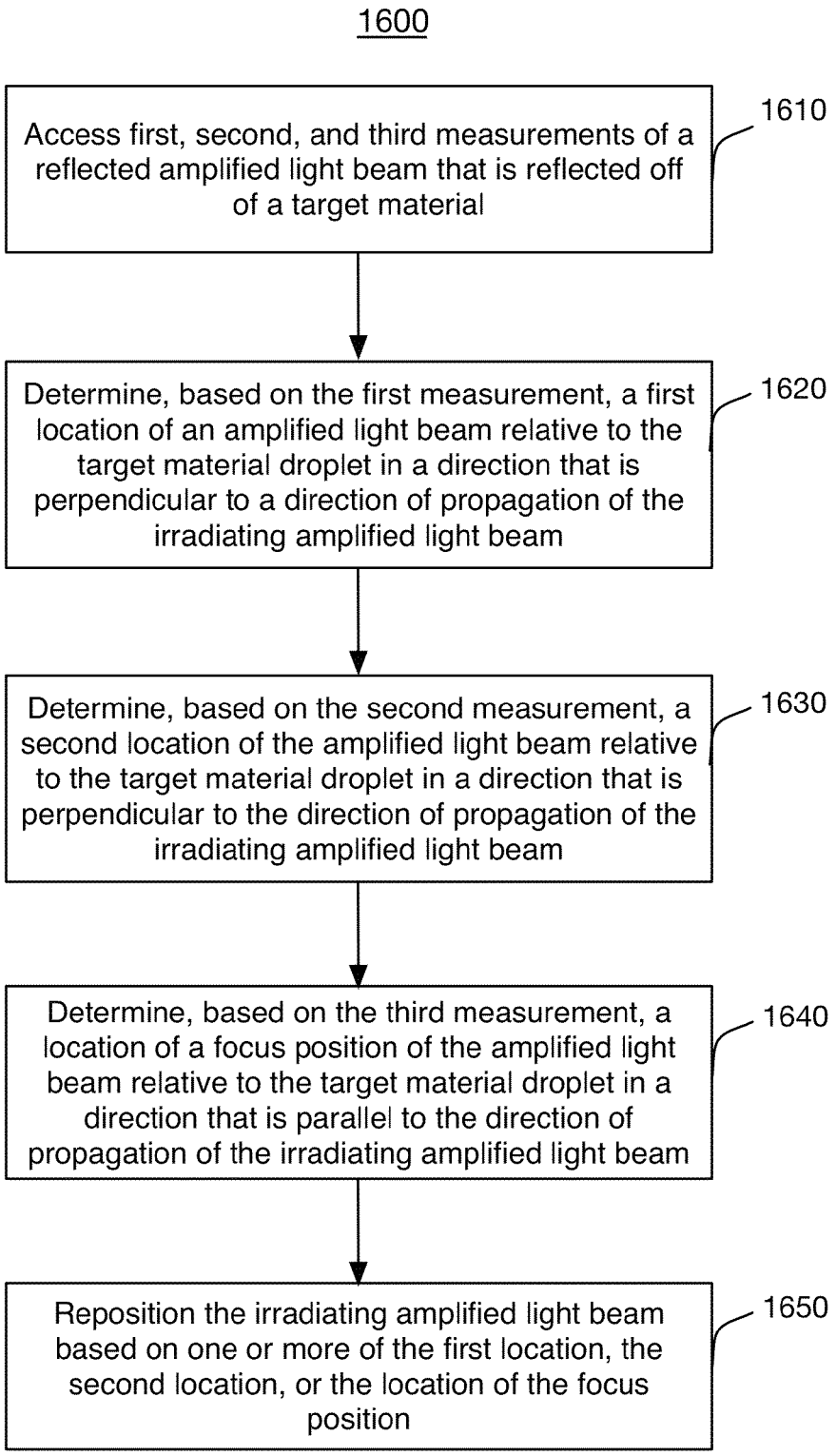
FIG. 16 is a flow chart of an exemplary process for aligning an irradiating amplified light beam relative to a target material.

Referring to FIG. 16, an example process 1600 for aligning an irradiating amplified light beam relative to a target material is shown. The process 1600 can be performed on data collected with any of the beam positioning systems 260, 700, or 1100. The process 1600 can be performed by the controller 280 and/or by an electronic processor in one or more of the sensors in the beam positioning system. In the discussion below, the process 1600 is discussed with respect to the beam positioning system 260.

First, second, and third measurements of a reflected amplified light beam are accessed (1610). The reflected amplified light beam is a beam that is reflected off of a target material. For example, the reflected amplified light beam can be the return beam 217. The first measurement is obtained from a first sensor, and the second and third measurements are obtained from a second sensor. For example, the first measurement can be obtained from the quadrant detector 420, and the second and third measurements can be obtained from the sensor 421. The first sensor has a higher data acquisition rate than the second sensor. As discussed above, using sensors of different data rates allows the process 1600 to account for changes in the alignment of the irradiating amplified light beam 216 that arise from multiple physical effects, some of which occur on shorter time frames than others. The second and third measurements can be obtained from a single sensor, such as the sensor 421, or the second and third measurements can be obtained from two different sensors. Obtaining the second and third measurements from the same sensor may result in a beam positioning system that is relatively compact and has fewer components. In some implementations, the second and third measurements are obtained from two different sensors, both of which can be identical.

Based on the first measurement, a first location of the irradiating amplified light beam 216 relative to the target material is determined (1620). The first location is in a direction that is transverse to the direction of propagation of the irradiating amplified light beam 216. For example, the direction can be the "x" direction or the "y" direction shown in FIG. 2B. Thus, the first location can be a location relative to the target material in the "x" or "y" direction. The first location can be expressed as a value that represents the distance between the irradiating amplified light beam 216 and the target material 246. In some implementations, the distance can be the distance between the focal plane 244 of the irradiating amplified light beam 216 and the target material 246. The distance can be between the irradiating amplified light beam 216 and the target location 242 (a location that is expected to receive the target material). The distance can be between the focus position of the amplified light beam 216 and the target location 242 or the target material.

In implementations in which the first sensor is the quadrant detector, the first location can be determined from the location of the spot 411 on the sensor 420. For example, if the spot 411 is on the left side of the sensor 420, the target material 246 is displaced from the focus position in the "y" direction. To determine the position of the spot 505 on the sensor 420, the energy sensed by each of the sensing elements 422*a*-422*d* is measured and compared.

When each of the sensing elements 422*a*-422*d* receives the same amount of energy from the beam 411, the spot 505 is in the center of the sensor 420 and the irradiating amplified light beam 216 is aligned with the target material 246 in the transverse direction. To determine the offset of the spot 505 from the center of the sensor 420, the energy at each sensing element 422*a*-422*d* is different. The vertical offset of the spot 505 from the center can be determined by subtracting the sum of the energy from the sensing elements 422*c* and 422*d* on the bottom portion of the sensor 420 from the sum of the energy from the sensing elements 422*a* and 422*b* on the top portion of the sensor 420. A negative value indicates that the center of the spot 505 is below the center of the sensor 420 and a positive value indicates that the center of the spot 505 is above the center of the sensor 420. The horizontal offset of the spot 505 is determined by subtracting the sum of the energy on the left side of the sensor 420 from the sum of the energy on the right side of the sensor 420. A negative value indicates that the center of the spot 505 is to the right of the center of the sensor 420 and a positive value indicates that the center of the spot 505 is to the left of the center of the sensor 420.

Based on the amount of offset, the controller 280 determines a corresponding amount to move one or more actuators in the actuation system 227 and/or the actuation system 228 to adjust the irradiating amplified light beam 216 to be aligned with the target material 246.

The signal difference between the sensing elements 422*a*-422*d* can be determined from a single frame of data from the sensor 420. In some implementations, multiple frames of data from the sensor 420 are averaged before determining the transverse distance between the droplet and the irradiating amplified light beam 216. For example, 16 or 250 frames of data from the sensor 420 can be averaged before determining the signal difference. Further, the signal difference can be divided by the total signal on all of the sensing elements 422*a*-422*d*.

Based on the second measurement, a second location of the irradiating amplified light beam 216 relative to the target material is determined (1630). The second location is also in a direction that is transverse to the direction of propagation of the irradiating amplified light beam 216 (the "x" or "y" directions of FIG. 2A). The second location can be in a direction that is perpendicular to the first location. For example, if the first location is a distance between the target material 246 and the irradiating amplified light beam 216 in the "x" direction, the second location can be a distance between the target material 246 and the irradiating amplified light beam 216 in the "y" direction.

The second location is determined from data that is taken with a sensor, such as the sensor 421, that has a lower data acquisition rate than the first sensor. Thus, even in implementations in which the second location and the first location are along the same direction, the second and first locations provide different information. For example, tracking the irradiating amplified light beam 216 location over time in a particular direction with data from the first sensor shows high-frequency variations in the position of the irradiating amplified light beam 216 while tracking the variations in position of the irradiating amplified light beam 216 over time in that direction with data from the second sensor shows low-frequency variations in the forward beam.

Based on the third measurement, a location of the focus position of the amplified light beam relative to the target material is determined (1640). The location of the focus position of the irradiating amplified light beam 216 is determined in a direction that is parallel to the direction of propagation of the forward beam (the "z" direction in FIG. 2A). The location of the focus position relative to the target material 246 can be determined by measuring the ellipticity of a spot formed by light that passes through an astigmatic optical element (FIGS. 7 and 11) or by using a series of non-astigmatic optical elements to create spots that each show a different cross-section of the irradiating amplified light beam 216 (FIGS. 12 and 14).

The irradiating amplified light beam is repositioned relative to the target material based on one or more of the first location, the second location, or the location of the focal plane to align the irradiating amplified light beam relative to the target material (1650). To align the irradiating amplified light beam 216 in the "x" or "y" direction, one or more actuators in the actuation systems 228 and 227 move mirrors, lenses, and/or mounts within the beam transport system 224 and/or focusing system 226 (FIG. 2A) to steer the irradiating amplified light beam 216 toward the target material 246. In implementations that use a pulsed forward beam, the irradiating amplified light beam 216 can alternatively or additionally be aligned in the "x" direction by delaying or advancing the pulse by a time that corresponds to the distance between the pulse and the target material in the "x" direction. To align the focal plane 244 or focus position of the beam 216 along the "z" direction, one or more actuators in the actuation system 227 moves a lens in the focusing system 227, resulting in repositioning of the focal plane 244 and focus position.

Other implementations are within the scope of the following claims.

What is claimed is:

1. A system for an extreme ultraviolet light source, the system comprising:

one or more optical elements positioned to receive a reflected amplified light beam and to direct the reflected amplified light beam into first, second, and third channels, the reflected amplified light beam comprising a reflection of at least a portion of an irradiating amplified light beam that interacts with a target material, and the first, second, and third channels being three separate paths along which light propagates;

a first sensor that senses light from the first channel;

a second sensor that senses light from the second channel and the third channel, the second sensor having a lower acquisition rate than the first sensor; and an electronic processor coupled to a computer-readable storage medium, the medium storing instructions that, when executed, cause the processor to:

receive data from the first sensor and the second sensor, and determine, based on the received data, a location of the irradiating amplified light beam relative to the target material in more than one dimension.

2. The system of claim 1, wherein the medium further stores instructions that, when executed, cause the processor to determine an adjustment to the irradiating amplified light beam based on the determined location.

3. The system of claim 2, wherein the determined adjustment comprises distances, in more than one dimension, to move the irradiating amplified light beam.

4. The system of claim 1, wherein the instructions to cause the processor to determine a location of the irradiating amplified light beam comprise instructions that, when executed cause the processor to:

determine a location of a focus position of the irradiating amplified light beam relative to the target material in a direction that is parallel to a direction of propagation of the irradiating amplified light beam, and determine a location of the focus position of the irradiating amplified light beam relative to the target material in a first transverse direction that is perpendicular to the direction of propagation of the irradiating amplified light beam.

5. The system of claim 4, wherein the instructions further comprise instructions that, when executed, cause the processor to determine a location of the expected focus position of the irradiating amplified light beam in a second transverse direction that is perpendicular to the first transverse direction and perpendicular to the direction of propagation of the irradiating amplified light beam.

6. The system of claim 1, further comprising an astigmatic optical element, positioned in the third channel, that modifies a wavefront of the reflected amplified light beam.

7. The system of claim 1, further comprising multiple partially reflective non-astigmatic optical elements, each positioned at a different location in the third channel and each receiving at least part of the reflected amplified light beam, each of the multiple partially reflective optical elements forming a beam that follows a path of a different length between the target material and the second sensor.

8. The system of claim 1, wherein the first, second, and third channels each comprise one or more refractive or reflective optical elements that direct a portion of the reflected amplified light beam.

9. The system of claim 1, wherein the reflected amplified light beam comprises a reflection of a pre-pulse beam and a drive beam, the drive beam being an amplified light beam that converts the target material to plasma upon interaction, and the pre-pulse and drive beams comprising different wavelengths, and the system further comprises one or more spectral filters that are transparent to only one of the pre-pulse beam and the drive beam.

10. The system of claim 1, wherein the first sensor senses light pointing at a high acquisition rate from the first channel;

the second sensor comprises a two-dimensional imaging sensor that senses light and measures intensity distribution of the light from the second channel and the third channel; and the instructions that, when executed, cause the processor to determine, based on the received data, a location of the irradiating amplified light beam, cause the processor to determine a focus position of the irradiating amplified light beam relative to the target material in more than one dimension.

11. An extreme ultraviolet light system comprising:

a source that produces an irradiating amplified light beam;

a steering system that steers and focuses the irradiating amplified light beam toward a target material in a vacuum chamber;

a beam positioning system comprising:

one or more optical elements positioned to receive a reflected amplified light beam that is reflected from the target material and to direct the reflected amplified light beam into first, second, and third channels, the first, second, and third channels being three separate paths along which light propagates;

a first sensor that senses light from the first channel;

a second sensor, comprising a two-dimensional imaging sensor, that senses light from the second channel and the third channel, the second sensor having a lower acquisition rate than the first sensor; and an electronic processor coupled to a computer-readable storage medium, the medium storing instructions that, when executed, cause the processor to:

receive data from the first sensor and the second sensor, and determine, based on the received data, a location of the irradiating amplified light beam relative to the target material in more than one dimension.

12. The system of claim 11, wherein the medium further stores instructions that, when executed, cause the processor to determine an adjustment to the location of the irradiating amplified light beam based on the determined location.

13. The system of claim 12, wherein the determined adjustment comprises an adjustment in more than one dimension.

14. The system of claim 13, wherein the instructions to cause the processor to determine a location of the irradiating amplified light beam relative to the target material comprise instructions that, when executed cause the processor to:

determine a location of a focus of the irradiating amplified light beam relative to the target material in a direction that is parallel to a direction of propagation of the irradiating amplified light beam, and determine a location of the irradiating amplified light beam focus relative to the target material in first and second transverse directions, each of which are perpendicular to the direction of propagation of the irradiating amplified light beam.

15. The system of claim 11, wherein the instructions further comprise instructions that, when executed, cause the processor to:

determine an adjustment to the amplified light beam based on the determined location of the amplified light beam, and provide the generated output to the steering system.

* * * * *